US009182694B2

(12) United States Patent
Yamada et al.

(10) Patent No.: US 9,182,694 B2
(45) **Date of Patent: *Nov. 10, 2015**

(54) TONER, IMAGE FORMING APPARATUS, IMAGE FORMING METHOD, AND PROCESS CARTRIDGE

(71) Applicant: Ricoh Company, Ltd., Ohta-ku (JP)

(72) Inventors: Saori Yamada, Shizuoka (JP); Hisashi Nakajima, Shizuoka (JP); Masashi Nagayama, Shizuoka (JP); Shinya Hanatani, Kanagawa (JP); Mariko Takii, Shizuoka (JP); Yoshitaka Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/827,972

(22) Filed: Mar. 14, 2013

(65) Prior Publication Data

US 2013/0244162 A1 Sep. 19, 2013

(30) Foreign Application Priority Data

| | | |
|---|---|---|
| Mar. 15, 2012 | (JP) | 2012-058440 |
| Sep. 11, 2012 | (JP) | 2012-199704 |
| Mar. 12, 2013 | (JP) | 2013-048923 |

(51) Int. Cl.

| | |
|---|---|
| ***G03G 9/087*** | (2006.01) |
| ***G03G 9/08*** | (2006.01) |
| ***G03G 9/097*** | (2006.01) |

(52) U.S. Cl.

CPC ..... *G03G 9/08755* (2013.01); *G03G 9/081* (2013.01); *G03G 9/0821* (2013.01); *G03G 9/08711* (2013.01); *G03G 9/08722* (2013.01); *G03G 9/08782* (2013.01); *G03G 9/08784* (2013.01); *G03G 9/08795* (2013.01); *G03G 9/08797* (2013.01); *G03G 9/09791* (2013.01)

(58) Field of Classification Search

CPC ..... G03G 9/08755; G03G 9/08764; G03G 9/08766; G03G 9/08784; G03G 9/08711; G03G 9/08797

USPC ..... 430/109.4, 108.3, 111.4, 109.3

See application file for complete search history.

(56) References Cited

U.S. PATENT DOCUMENTS

| | | | | |
|---|---|---|---|---|
| 5,219,697 | A * | 6/1993 | Mori et al. | 430/108.3 |
| 2001/0018157 | A1 | 8/2001 | Aoki et al. | |
| 2008/0102393 | A1 | 5/2008 | Hasegawa | |
| 2011/0217646 | A1* | 9/2011 | Shirai et al. | 430/109.4 |
| 2012/0082926 | A1 | 4/2012 | Suzuki et al. | |
| 2012/0237868 | A1 | 9/2012 | Yamada et al. | |
| 2012/0251168 | A1 | 10/2012 | Nagayama et al. | |
| 2013/0252160 | A1* | 9/2013 | Nagayama et al. | 430/109.4 |

FOREIGN PATENT DOCUMENTS

| | | | | |
|---|---|---|---|---|
| CN | 102190871 | A | | 9/2011 |
| CN | 103048897 | A | | 4/2013 |
| JP | 60-090344 | | | 5/1985 |
| JP | 62-063940 | | | 3/1987 |
| JP | 64-015755 | | | 1/1989 |
| JP | 02-082267 | | | 3/1990 |
| JP | 03-041470 | | | 2/1991 |
| JP | 03-229264 | | | 10/1991 |
| JP | 2931899 | | | 5/1999 |
| JP | 11-305486 | | | 11/1999 |
| JP | 2000-242039 | | | 9/2000 |
| JP | 2001-222138 | | | 8/2001 |
| JP | 2002082484 | A | * | 3/2002 |
| JP | 2002162785 | A | * | 6/2002 |
| JP | 2002-287399 | | | 10/2002 |
| JP | 2003-029462 | | | 1/2003 |
| JP | 2004-046095 | | | 2/2004 |
| JP | 2004-053995 | | | 2/2004 |
| JP | 2005-338814 | | | 12/2005 |
| JP | 2007-033773 | | | 2/2007 |
| JP | 2008-116580 | | | 5/2008 |
| JP | 4118498 | | | 5/2008 |
| JP | 2008-310280 | | | 12/2008 |
| JP | 2012-078423 | | | 4/2012 |

OTHER PUBLICATIONS

English language machine translation of JP 2002-162785 (Jun. 2002).*

English language machine translation of JP 2002-082484 (Mar. 2002).*

U.S. Appl. No. 13/826,742, filed Mar. 14, 2013, Nakajima, et al.

U.S. Appl. No. 13/826,791, filed Mar. 14, 2013, Nagayama, et al.

Office Action in Chinese Application No. 201310082630.3 issued Aug. 20, 2014 (with English translation of Office Action).

* cited by examiner

*Primary Examiner* — Christopher Rodee

(74) *Attorney, Agent, or Firm* — Oblon, McClelland, Maier & Neustadt, L.L.P.

(57) ABSTRACT

A toner, including: a binder resin; and a colorant, wherein the binder resin contains: a crystalline polyester resin (A); a non-crystalline resin (B); and a composite resin (C), where the composite resin (C) contains a condensation polymerization resin unit and an addition polymerization resin unit, wherein the toner contains chloroform insoluble matter in an amount of 1% by mass to 30% by mass, wherein the toner has a molecular weight distribution having a main peak in a range of 1,000 to 10,000 and a half width of 15,000 or less, where the molecular weight distribution is obtained through gel permeation chromatography (GPC) of tetrahydrofuran soluble matter of the toner, and wherein the toner has an endothermic peak in a range of 90° C. to 130° C. in measurement through differential scanning calorimetry (DSC).

20 Claims, 4 Drawing Sheets

TONER, IMAGE FORMING APPARATUS, IMAGE FORMING METHOD, AND PROCESS CARTRIDGE

BACKGROUND OF THE INVENTION

1. Field of the Invention

The present invention relates to: a toner for forming an image through electrophotography; and an image forming apparatus, an image forming method, and a process cartridge each of which uses the toner.

2. Description of the Related Art

In recent years, toners for use in electrophotography have been demanded to be fixed at lower temperatures. This demand results from energy saving achieved by reducing energy for fixing and also from requirements for increasing process speed and image quality of electrophotographic image forming apparatus.

In general, as the process speed of electrophotographic image forming apparatus is increased, the image quality thereof is degraded. The reasons why this phenomenon occurs depend on various factors. However, among them, the greatest factor is an effect of fixing failures in a fixing step of an image forming process.

In the fixing step, a prefixed toner image on a recording medium typified by paper is fixed on the recording medium by heat and pressure to be a fixed toner image. In a rapid system speed, a prefixed toner image cannot receive a sufficient amount of heat in the fixing step. As a result, fixing failures occur to potentially roughen the surface of the finally obtained toner image or cause afterimage formation called cold offset, leading to failure images. In one possible measure to avoid fixing failures, a fixing temperature is increased in accordance with an increase in the system speed in order to keep image quality. Such an increased fixing temperature is not necessarily the best measure from the viewpoints of: adverse side effects of leakage of heat from a fixing device on other processes in the image forming apparatus; acceleration of abrasion speed of fixing members; and increase in consumption energy.

In view of this, particularly in high-speed image forming apparatus, improvements in fixing performance of toners themselves have been required. More specifically, demand has arisen for toners exhibiting sufficient fixing property at lower temperatures in the fixing step.

Conventionally, various attempts have been made to improve fixing property of toners. In one known method for improving fixing property of toners, binder resins contained in toners are controlled in terms of thermal characteristics typified by glass transition temperature (Tg) and softening temperature (T1/2). However, a resin having a lowered Tg causes degradation of heat resistance storageability, and a drop in T1/2 of a resin, which is attained by reducing its molecular weight, raises problems such as occurrence of hot offset. Therefore, only controlling thermal characteristics of a resin itself is not enough to obtain a toner satisfactory in all of low-temperature fixing property, heat resistance storageability and hot offset resistance.

In proposals of changing the kind of a binder resin for responding to fixing at lower temperature, widely-used conventional stryene-acryl resins are changed to polyester resins excellent in low-temperature fixing property and better in heat resistance storageability (see Japanese Patent Application Laid-Open (JP-A) Nos. 60-90344, 64-15755, 02-82267, 03-229264, 03-41470 and 11-305486). In another proposal, a binder is supplemented with a specific non-olefin crystalline polymer exhibiting sharp melt property at its glass transition temperature to improve low-temperature fixing property (see JP-A No. 62-63940). In these proposals, however, it cannot be said that resultant toners are optimized in molecular structure and molecular weight. There is a problem that they do not have sufficient low-temperature fixing property.

In addition, it has been proposed to use a crystalline polyester having sharp melt property similar to the above specific non-olefin crystalline polymer in a toner in order to improve its fixing property (see Japanese Patent (JP-B) No. 2931899 and JP-A No. 2001-222138). In this proposal, however, the acid value and the hydroxyl value of the crystalline polyester used in the toner are as low as 5 mgKOH/g or lower and 20 mgKOH/g or lower, respectively. The crystalline polyester has low affinity to paper, raising a problem that the toner does not have sufficient low-temperature fixing property.

In this proposal, optimization is not made on the molecular weight of the finally obtained toner and the existing state of the crystalline polyester. Therefore, toners obtained using the crystalline polyester of this proposal cannot sufficiently exhibit excellent low-temperature fixing property or heat resistance storageability attributed to the crystalline polyester, which is problematic. Also, it does not respond to requirements on hot offset resistance, raising a problem that a range of temperature for good image fixing cannot be ensured.

In one proposed method for controlling the existing state of the crystalline polyester, a crystalline polyester resin and a non-crystalline polyester resin, which are not compatible, are used to establish a sea-island, phase-separated structure (see JP-A No. 2004-46095). This proposal uses three different kinds of resins including a crystalline polyester resin as binder resins of toner. However, trying to maintain the sea-island structure of the crystalline polyester resin results in an increase in dispersion diameter of the crystalline polyester, which raises problems of potentially leading to degradation of heat resistance storageability, causing transfer failures in a transfer step due to excessively lowered electrical resistance, and roughening the finally obtained image.

In still another proposal, a toner is provided with low-temperature fixing property and heat resistance storageability by defining the peak endothermic amount in a DSC curve measured with a differential scanning calorimeter to thereby control the existing state of a crystalline polyester resin for allowing the crystalline polyester resin to significantly exhibit its effects (see JP-A No. 2007-33773). In this proposal, however, the crystalline polyester resin is supposed to be used in combination with a non-crystalline polyester resin having a relatively high softening temperature. Therefore, the crystalline polyester resin is responsible for development of low-temperature fixing property, which naturally increases the amount of the crystalline polyester resin. As a result, the crystalline polyester resin and the non-crystalline polyester resin become in a compatible state to impair heat resistance storageability.

It has been proposed to incorporate into a toner an ester bond-containing crystalline polyester resin having a specific structure as a method for attaining low-temperature fixing property, heat resistance storageability and hot offset resistance at the same time (see JP-A No. 2005-338814). In this proposal, however, since the amount of the crystalline polyester resin incorporated is quite large, the crystalline polyester resin and the non-crystalline polyester resin turn into a compatible state, raising a problem that the heat resistance storageability is degraded.

In even another proposed method, a toner is defined in terms of the peak and the half width of its molecular weight distribution and of the amount of its chloroform insoluble matter, and two or more kinds of resins having different softening temperatures are used as a binder resin (see JP-B No. 4118498). In this proposal, however, since a crystalline polyester resin is not used, the low-temperature fixing property is inferior to a toner formed using a crystalline polyester resin.

As described above, at present, there is not a toner that is satisfactory in all of low-temperature fixing property, hot offset resistance and heat resistance storageability at the same time and in a balanced manner.

SUMMARY OF THE INVENTION

The present invention aims to solve the above problems pertinent in the art and achieve the following object. That is, an object of the present invention is to provide a toner that is satisfactory in all of low-temperature fixing property, hot offset resistance and heat resistance storageability in a balanced manner and can form a high-quality image for a long period of time.

Means for solving the above problems are as follows.

That is, a toner of the present invention includes:

a binder resin; and a colorant, wherein the binder resin contains: a crystalline polyester resin (A); a non-crystalline resin (B); and a composite resin (C), where the composite resin (C) contains a condensation polymerization resin unit and an addition polymerization resin unit, wherein the toner contains chloroform insoluble matter in an amount of 1% by mass to 30% by mass, wherein the toner has a molecular weight distribution having a main peak in a range of 1,000 to 10,000 and a half width of 15,000 or less, where the molecular weight distribution is obtained through gel permeation chromatography (GPC) of tetrahydrofuran soluble matter of the toner, and wherein the toner has an endothermic peak in a range of 90° C. to 130° C. in measurement through differential scanning calorimetry (DSC).

The present invention can provide a toner that is satisfactory in all of low-temperature fixing property, hot offset resistance and heat resistance storageability in a balanced manner and can form a high-quality image for a long period of time. The toner of the present invention can solve the above problems pertinent in the art and can achieve the above object.

DETAILED DESCRIPTION OF THE INVENTION

Figure 1:
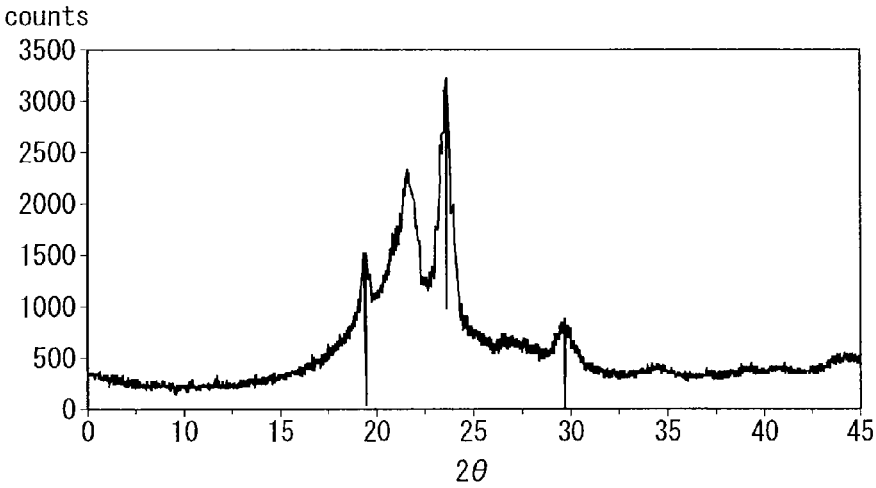
FIG. 1 is an X-ray diffraction chart of a crystalline polyester resin a6 used in Examples.

Next, technical ideas of the present invention will be described in more detail.

In recent years, toners for use in electrophotography have been demanded to be fixed at lower temperatures. This demand results from energy saving achieved by reducing energy for fixing and also from requirements for increasing process speed and image quality of electrophotographic image forming apparatus. In addition, as a result of diversification of usage purposes of electrophotographic image forming apparatus, requirements for low-temperature fixing have been being increasing.

A toner can be fixed at lower temperatures by decreasing its softening temperature (T1/2). However, decreasing the softening temperature decreases its glass transition temperature to impair heat resistance storageability. In addition, hot offset resistance is also impaired due to a drop in the lower-limit fixing temperature (i.e., the lower-limit temperature at which fixing can be performed without problems on image quality) and to a drop in the upper-limit fixing temperature (i.e., the upper-limit temperature at which fixing can be performed). Therefore, satisfying these three properties of low-temperature fixing property, heat resistance storageability and hot offset resistance in a balanced manner is a quite difficult proposition for designers of toners for forming an electrophotographic image.

Furthermore, in recent years, an image forming method using an intermediate transfer member has been proposed in order to improve responsiveness to various kinds of recording media (responsiveness to paper). However, an external additive tends to be embedded in the toner as the intermediate transfer member is improved in durability. Such an image forming method involves transfer failures more frequently than in an image forming method where an image is transferred directly from an electrophotographic photoconductor to a recording media (paper), raising a problem of roughening the finally obtained image.

Therefore, establishing an image forming method that is satisfactory in all of low-temperature fixing property, hot offset resistance and heat resistance stability in a balanced manner as well as is excellent in transferability even when used for an image forming apparatus using an intermediate transfer member is a quite difficult proposition for designers of image forming apparatus.

The present inventors conducted extensive studies on the above proposition and have found out the following technical matters to arrive at solving the above problems.

Specifically, use of a crystalline polyester resin (A) as a binder resin for an electrophotographic image forming toner can provide a toner with low-temperature fixing property and heat resistance storageability by virtue of its sharp melt property.

However, when the crystalline polyester resin (A) is used alone as a binder resin, hot offset resistance becomes quite poor, which narrows a fixable temperature range to an extent that the formed toner cannot be practically used.

In view of this, the present inventors conceived that combining the crystalline polyester resin (A) with a non-crystalline resin (B) containing chloroform insoluble matter can improve hot offset resistance and widen a fixable temperature range.

However, when the amount of the non-crystalline resin (B) is large in a toner containing the crystalline polyester resin (A) and the non-crystalline resin (B), the obtained low-temperature fixing property becomes poor. Meanwhile, when the amount of the crystalline polyester resin (A) is large, the crystalline polyester resin (A) turns into a compatible state with the other components than the chloroform insoluble matter of the non-crystalline resin (B) when melt-kneaded in the production process. As a result, the entire binder resin is considerably decreased in glass transition temperature to degrade heat resistance storageability extremely.

In view of this, the present inventors conducted further studies and have found that by making the toner have a molecular weight distribution having a main peak in a range of 1,000 to 10,000 and a half width of 15,000 or less where the molecular weight distribution is obtained through gel permeation chromatography (GPC) of tetrahydrofuran (THF) soluble matter of the toner, the absolute amount of low-molecular-weight components is large, the molecular weight distribution becomes sharp, the amount of the crystalline polyester resin (A) is decreased to prevent compatibility, and the hot offset resistance of the non-crystalline resin (B) is not impaired while keeping the low-temperature fixing property of the crystalline polyester resin (A).

Still, a risk to heat-resistant storageability does not completely disappear. Even though compatibility of the crystalline polyester resin (A) is suppressed and decrease of the glass transition temperature of the binder resin as a whole is suppressed, interfaces between the crystalline polyester resin (A) and the other binder resins tends to become a pulverization interface in a pulverizing step if the crystalline polyester resin (A) exists with its dispersion diameter remaining large. Also in the polymerization method, as a result, the crystalline polyester resin (A) tends to appear on a toner surface. The crystalline polyester resin (A) is a sharp-melting material, and it exhibits excellent heat resistance storageability as described above when it exists inside toner particles. However, it slightly melts even at a temperature equal to or lower than the glass transition temperature, and the slightly melt crystalline polyester resin (A) acts as a binder between toner particles when it exists on surfaces of the toner particles. As a result, it degrades heat resistance storageability of the toner. Besides, in an image forming apparatus using an intermediate transfer member, an external additive tends to be embedded in the toner base particles as the intermediate transfer member is improved in durability, easily causing transfer failures. This phenomenon is particularly pronounced in a crystalline polyester resin having a low degree of crystallization.

Also, in view of electrical characteristics of the toner, a problem occurs with a toner formulated with the crystalline polyester resin (A) and the non-crystalline resin (B). Since a polyester resin with crystallinity has a relatively low electrical resistance, a toner tends to have a low electrical resistance if the polyester resin with crystallinity exists in the toner with its dispersion diameter remaining large. When the electrical resistance decreases and exceeds its allowable range, it causes poor image transfer in a transferring step during image formation. In particular, when the compatibility of the crystalline polyester resin (A) is suppressed for the purpose of maintaining low-temperature fixing property as described above, the crystalline polyester resin (A) tends to maintain its large dispersion diameter. As a result, the electrical characteristics of the crystalline polyester resin (A) are likely to be dominant in the toner, and the electrical resistance tends to decrease to easily cause degraded transferability.

Also, when a resistance adjusting agent (hereinafter may be referred to as "charge-controlling agent") is included as described below, the resistance adjusting agent exists in the other resins than the crystalline polyester resin (A) at a relatively high concentration since it cannot enter domains formed by the crystalline polyester resin (A). Thus, it tends to be confined in the toner as aggregates, and the resistance tends to decrease excessively. The problem may be solved by adjusting the amount of the resistance adjusting agent if it is used only for the purpose of decreasing the resistance. However, if the resistance adjusting agent serves as a colorant also, an example thereof being carbon black, it is not necessarily possible to reduce the amount in view of coloring strength, and it cannot be adjusted to appropriate electrical resistance.

The present inventors conducted extensive studies to solve these problems. As a result, they have found that concerns of reduced heat resistance storageability and reduced electrical resistance which develop characteristically in a formulation of the crystalline polyester resin (A) and the non-crystalline resin (B) may be solved simultaneously by formulating a composite resin (C) containing a condensation polymerization resin unit and an addition polymerization resin unit to the formulation of the crystalline polyester resin (A) and the non-crystalline resin (B).

Also, the present inventors conducted extensive studies to solve these problems. As a result, they have found that concerns of reduced heat resistance storageability and reduced electrical resistance may be solved simultaneously, even in an image forming method using an intermediate transfer member, by externally adding an inorganic compound having an average primary particle diameter of 40 nm to 160 nm to the toner containing the composite resin (C) containing a condensation polymerization resin unit and an addition polymerization resin unit as well as the crystalline polyester resin (A) and the non-crystalline resin (B).

When the crystalline polyester resin (A) is melt-kneaded together with the low-molecular-weight non-crystalline resin (B) having a molecular weight distribution having a main peak in a range of 1,000 to 10,000 and a half width of 15,000 or less where the molecular weight distribution is obtained through GPC of THF soluble matter of thereof, shear force cannot be very well applied to raw materials since the viscosity of the resins considerably decreases, and thus the dispersion diameter of the crystalline polyester resin (A) tends to be larger. On the other hand, when the crystalline polyester resin (A) and the non-crystalline resin (B) are melt-kneaded together with the composite resin (C), appropriate shear force is applied to the resins, and fine dispersion of the crystalline polyester resin (A) is promoted.

When it is finely dispersed, the crystalline polyester resin (A) appears on a toner surface less frequently during pulverization, and the heat resistance storageability dramatically improves. Also, it is possible to maintain appropriate electrical resistance since the crystalline polyester resin (A) is finely dispersed.

Furthermore, the composite resin (C) tends to be a pulverization interface during pulverization since it is harder than the non-crystalline resin (B) having a peak in a region of relatively low molecular weight of a molecular weight distribution. Thus, it tends to be present relatively on the toner surface and effectively suppresses the non-crystalline resin (B) having a low softening temperature appearing on the toner surface, which contributes to improved heat-resistant storageability.

In addition, since hardness of the toner surface may be enhanced, toner degradation is minimal when the toner is physically stressed. In particular, since embedding of an external additive is improved, variation in charging characteristics is reduced before and after stress is applied. Accordingly, it is possible to provide stable image quality over a long period of time.

However, even though a combination of the crystalline polyester resin (A), the non-crystalline resin (B) and the composite resin (C) is used, there may be cases where advantages coming from thermal properties of the raw material resins are not exhibited, when melt-kneading is performed in the pulverization toner production step. This is mainly because of change in the molecular weight due to breakage of molecular chains in the resins in the melt-kneading step. In particular, the molecular weight distribution of the toner as a whole becomes broad when a chain of chloroform insoluble matter included in the binder resin is broken. This negatively affects the thermal properties coming from the non-crystalline resin (B), and low-temperature fixing property is impaired.

The present inventors have found the following as a result of extensive studies. As described below, for example, by melt-kneading raw material resins over a moderate temperature to optimize shear force on the raw material resins and to re-crystallize the crystalline polyester resin (A) in a cooling step, the obtained toner has a molecular weight distribution having a main peak between 1,000 and 10,000 and a half width of 15,000 or less, where the molecular weight distribution is obtained by GPC of THF soluble matter of the toner. Such a toner has a large absolute amount of low molecular-weight content and a sharp molecular weight distribution, and can be excellent in low-temperature fixing property, heat resistance storageability and hot offset resistance at the same time and in a balanced manner, while utilizing the characteristics of the crystalline polyester resin (A), the non-crystalline resin (B) and the composite resin (C), respectively. Also, by externally adding an inorganic compound having an average primary particle diameter of 40 nm to 160 nm, it is possible to obtain an image forming method that is satisfactory in all of low-temperature fixing property, hot offset resistance and heat resistance storageability in a balanced manner as well as is excellent in transferability even when used for an image forming apparatus using an intermediate transfer member.

(Toner)

A toner of the present invention contains at least a binder resin and a colorant; and, if necessary, further contains other ingredients such as a charge-controlling agent, a fatty acid amide compound, a releasing agent and an external additive.

The binder resin contains a crystalline polyester resin (A), a non-crystalline resin (B), and a composite resin (C) containing a condensation polymerization resin unit and an addition polymerization resin unit.

The toner is preferably produced through melt-kneading and pulverizing.

<Crystalline Polyester Resin (A)>

The crystalline polyester resin (A) is not particularly limited and may be appropriately selected from conventionally known ones depending on the intended purpose so long as it is a polyester resin having crystallinity. The crystalline polyester resin (A) preferably has an ester bond represented by the following General Formula (1) in a molecular backbone thereof.

$$—[OCO—R—COO—(CH_2)_n]— \quad \text{General Formula (1)}$$

In General Formula (1), R represents a C2-C20 linear, unsaturated, aliphatic, divalent carboxylic acid residue, and n is an integer of 2 to 20.

The presence of the ester bond represented by the above General Formula (1) in the crystalline polyester resin (A) can be identified by solid $C^{13}$NMR, for example.

The linear, unsaturated, aliphatic, divalent carboxylic acid residue is not particularly limited and may be appropriately selected depending on the intended purpose. Examples thereof include linear, unsaturated, aliphatic residues derived from linear, unsaturated, divalent carboxylic acids such as maleic acid, fumaric acid, 1,3-n-propenedicarboxylic acid and 1,4-n-butenedicarboxylic acid.

In General Formula (1), $(CH_2)_n$ is a linear, aliphatic, divalent alcohol residue.

The linear, aliphatic, divalent alcohol residue is not particularly limited and may be appropriately selected depending on the intended purpose. Examples thereof include residues derived from linear, aliphatic, divalent alcohol residues such as ethylene glycol, 1,3-propylene glycol, 1,4-butanediol and 1,6-hexanediol.

When an acid component of the crystalline polyester resin (A) is a linear, unsaturated, aliphatic dicarboxylic acid, it is advantageously easier to form a crystalline structure as compared with a case of using an aromatic dicarboxylic acid, making it possible for the crystalline polyester resin to exhibit its functions more effectively.

For example, the crystalline polyester resin (A) can be produced through condensation polymerization reaction between (I) a polyvalent carboxylic acid component of a linear, unsaturated, aliphatic, divalent carboxylic acid or a reactive derivative thereof (e.g., an acid anhydride, a C1-C4 lower alkyl ester or an acid halide) and (II) a polyhydric alcohol component of a linear, aliphatic diol.

A small amount of another polyvalent carboxylic acid may optionally be added to the above polyvalent carboxylic acid component. Examples of the another polyvalent carboxylic acid include (i) saturated, aliphatic, divalent carboxylic acids having a branched chain, (ii) saturated, aliphatic, polyvalent carboxylic acids such as saturated, aliphatic, divalent carboxylic acids and saturated, aliphatic, trivalent carboxylic acids, and (iii) aromatic polyvalent carboxylic acids such as aromatic, divalent carboxylic acids and aromatic, trivalent carboxylic acids.

The amount of these polyvalent carboxylic acids is not particularly limited and may be appropriately selected depending on the intended purpose, but is preferably 30 mol % or less, more preferably 10 mol % or less, relative to all the carboxylic acids. They are appropriately added in such an amount that the obtained polyester resin has crystallinity.

Examples of the optionally-added polyvalent carboxylic acids include: divalent carboxylic acids such as malonic acid, succinic acid, glutaric acid, adipic acid, suberic acid, cebacic sebacic acid, citraconic acid, phthalic acid, isophthalic acid and terephthalic acid; and tri- or higher-valent carboxylic acids such as trimellitic anhydrides, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane and 1,2,7,8-octanetetracarboxylic acid.

Furthermore, to the above polyhydric alcohol component may be optionally added a small amount of an aliphatic, branched, dihydric alcohol, a cyclic, dihydric alcohol or a tri- or higher-hydric alcohol.

The amount of these polyhydric alcohols is not particularly limited and may be appropriately selected depending on the intended purpose, but is preferably 30 mol % or lower, more preferably 10 mol % or lower, relative to all the alcohols. They are appropriately added in such an amount that the obtained polyester resin has crystallinity.

Examples of the optionally-added polyhydric alcohols include 1,4-bis(hydroxymethyl)cyclohexane, polyethylene glycol, bisphenol A ethylene oxide adducts, bisphenol A propylene oxide adducts, and glycerin.

The molecular weight distribution of the crystalline polyester resin (A) is not particularly limited and may be appropriately selected depending on the intended purpose. The molecular weight distribution thereof is preferably sharp from the viewpoint of development of low-temperature fixing property. Also, the molecular weight of the crystalline polyester resin (A) is preferably relatively low.

Regarding the molecular weight of the crystalline polyester resin (A), preferably, the weight average molecular weight (Mw) thereof is 5,500 to 6,500 and the number average molecular weight (Mn) thereof is 1,300 to 1,500 in a molecular weight distribution through GPC of its o-dichlorobenzene soluble matter. The ratio (Mw/Mn) of the weight average molecular weight to the number average molecular weight is preferably 2 to 5.

The GPC can be performed, for example, as follows. Specifically, a column is conditioned in a heat chamber of 40° C., and then o-dichlorobenzene as a solvent is caused to pass through the column of the same temperature at a flow rate of 1 mL/min. Subsequently, a separately prepared o-dichlorobenzene solution of a resin sample (concentration: 0.05% by mass to 0.6% by mass) is applied to the column in an amount of 50 μL to 200 μL. In the measurement of the molecular weight of the sample, the molecular weight distribution is determined based on the relationship between the logarithmic value and the count number of a calibration curve given by using several monodispersed polystyrene-standard samples.

The molecular weight distribution of the crystalline polyester resin (A) is based on a molecular weight distribution chart where the horizontal axis is log (M: molecular weight) and the vertical axis is % by mass. In the molecular weight distribution chart, preferably, the molecular weight peak of the crystalline polyester resin (A) is in a range of 3.5% by mass to 4.0% by mass and the half width of this peak is 1.5 or less.

The glass transition temperature (Tga) or the softening temperature (T1/2a) of the crystalline polyester resin (A) is not particularly limited and may be appropriately selected depending on the intended purpose, but is preferably lower in such a range that the formed toner is not degraded in heat resistance storageability. The Tga is preferably 80° C. to 130° C., more preferably 80° C. to 125° C. The T1/2a is preferably 80° C. to 130° C., more preferably 80° C. to 125° C. When the Tga or the T1/2a deviates from the above range, the lower-limit fixing temperature of the toner becomes high, so that its low-temperature fixing property may be degraded.

Here, the glass transition temperature (Tg) of the binder resin can be measured by raising the temperature of the binder resin at 10° C./min from 20° C. to 150° C. using a differential scanning calorimeter (e.g., DSC-60, product of Shimadzu Corporation, Ltd.). Note that, the endothermic peak and the glass transition temperature in the present invention are obtained from an endothermic curve at the first temperature raising.

The softening temperature (T1/2) of the binder resin can be measured using an elevated flow tester CFT-500 (product of Shimadzu Corporation, Ltd.) by melting and flowing a sample of 1 $cm^3$ under the conditions: the diameter of a die hole: 1 mm, the pressure applied: 20 $kg/cm^2$ and the temperature raising rate: 6° C./min. The softening temperature (T1/2) thereof is a temperature corresponding to ½ the range between a flow start point and a flow end point.

In the present invention, whether or not the polyester resin has crystallinity can be identified based on whether or not there is a peak in an X-ray diffraction pattern thereof obtained with a powder X-ray diffraction apparatus.

The crystalline polyester resin (A) preferably has at least one diffraction peak at 2θ of 19° to 25° in its diffraction pattern, more preferably has a diffraction peak at 2θ of each of (i) 19° to 20°, (ii) 21° to 22°, (iii) 23° to 25° and (iv) 29° to 31°. Also, when the melt-kneaded and pulverized toner has a diffraction peak at 2θ of 19° to 25°, it means that the crystalline polyester resin (A) maintains crystallinity. In this case, the crystalline polyester resin (A) can be allowed to exhibit its function assuredly, which is preferred.

The measurement by powder X-ray diffraction can be performed using, for example, powder X-ray diffraction apparatus RINT 1100 (product of Rigaku Corporation, Ltd.) under the following conditions: vacuum tube: Cu; tube voltage-current: 50 kV-30 mA; and goniometer: a wide-angle goniometer. As specific examples, an X-ray diffraction chart of crystalline polyester resin a6 used in Examples is given in FIG. 1, and an X-ray diffraction chart of a toner obtained in Example 1-24 (which contains the crystalline polyester resin a6 and keeps its crystallinity) is given in FIG. 2.

The amount of the crystalline polyester resin (A) contained in the toner is not particularly limited and may be appropriately selected depending on the intended purpose, but is preferably 1% by mass to 15% by mass, more preferably 1% by mass to 10% by mass.

<Non-Crystalline Resin (B)>

The non-crystalline resin (B) is not particularly limited and may be appropriately selected from conventionally known ones depending on the intended purpose. Examples thereof include polystyrenes, polychlorostyrenes, poly(α-methylstyrenes), styrene-chlorostyrene copolymers, styrene-propylene copolymers, styrene-butadiene copolymers, styrene-vinylchloride copolymers, styrene-vinyl acetate copolymers, styrene-maleic acid copolymers, styrene-acrylic acid ester copolymers (e.g., styrene-methyl acrylate copolymers, styrene-ethyl acrylate copolymers, styrene-butyl acrylate copolymers, styrene-octyl acrylate copolymers and styrene-phenyl acrylate copolymers), styrene-methacrylic acid ester copolymers (e.g., styrene-methyl methacrylate copolymers, styrene-ethyl methacrylate copolymers, styrene-butyl methacrylate copolymers and styrene-phenyl methacrylate copolymers), styrene resins including homopolymers and copolymers of styrene and styrene-substituted products (e.g., styrene-α-chloromethyl acrylate copolymers and styrene-acrylonitrile-acrylic acid ester copolymers), vinyl chloride resins, styrene-vinyl acetate copolymers, rosin-modified maleic acid resins, phenol resins, epoxy resins, polyethylene resins, polypropylene resins, ionomer resins, polyurethane resins, silicone resins, ketone resins, ethylene-ethyl acrylate copolymers, xylene resins, petroleum resins such as polyvinyl butyral resins, and hydrogenated petroleum resins. These may be used alone or in combination.

Methods for producing these resins are not particularly limited and may be any of mass polymerization, solution polymerization, emulsion polymerization and suspension polymerization.

The non-crystalline resin (B) is preferably a polyester resin from the viewpoint of development of low-temperature fixing property. The polyester resin usable is, for example, one generally obtained through condensation polymerization between an alcohol and a carboxylic acid.

The alcohol is not particularly limited and may be appropriately selected depending on the intended purpose. Examples thereof include: glycols such as ethylene glycol, diethylene glycol, triethylene glycol and propylene glycol; ethylated bisphenols such as 1,4-bis(hydroxymethyl)cyclohexane and bisphenol A; and other polyhydric alcohol monomers such as divalent alcohol monomers and tri- or higher-hydric alcohol monomers.

The carboxylic acid is not particularly limited and may be appropriately selected depending on the intended purpose.

Examples thereof include: divalent organic acid monomers such as maleic acid, fumaric acid, phthalic acid, isophthalic acid, terephthalic acid, succunic acid and malonic acid; and tri- or higher-valent carboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane and 1,2,7,8-octanetetracarboxylic acid.

The polyester resin preferably has a glass transition temperature Tg of 55° C. or higher, more preferably 60° C. or higher, from the viewpoint of heat resistance storageability.

The non-crystalline resin (B) preferably contains chloroform insoluble matter. In particular, it is preferable that the formed toner contains chloroform insoluble matter in an amount of 1% by mass to 30% by mass, since it is possible to ensure the amounts of the other resin than the non-crystalline resin (B) while keeping hot offset resistance.

The chloroform insoluble matter of the non-crystalline resin (B) is measured as follows.

About 1.0 g of the non-crystalline resin (B) is weighed, and about 50 g of chloroform is added to the non-crystalline resin (B), followed by thoroughly dissolving. The resultant solution is subjected to centrifugal separation, and the resultant product is filtrated at normal temperature using a qualitative filter paper of class 5C of JIS (P3801). The residue on the filter paper is the insoluble matter. The amount of the chloroform insoluble matter is expressed as a ratio (% by mass) of the mass of the residue on the filter paper to the mass of the binder resin or toner used.

The non-crystalline resin (B) preferably has a molecular weight distribution having a main peak in a range of 1,000 to 10,000 and a half width of 15,000 or lower, where the molecular weight distribution is obtained through gel permeation chromatography (GPC) of THF soluble matter of the non-crystalline resin (B). Since such non-crystalline resin (B) exhibits excellent low-temperature fixing property, it can keep low-temperature fixing property at a sufficient level even when the amount of the crystalline polyester resin (A) in the toner is reduced. As a result of the extensive studies conducted by the present inventors, in a toner produced by combining the crystalline polyester resin (A), the non-crystalline resin (B) and the composite resin (C) together, it has been found that when the proportion of the non-crystalline resin (B) is increased, the best balance therebetween is obtained; i.e., the respective resins effectively exhibit their functions with accompanying neither adverse side effects due to excessive crystalline polyester resin and/or excessive THF insoluble matter nor adverse effects of the hardness of the composite resin (C) on a lower-limit temperature of the toner, so that the toner becomes good in low-temperature fixing property, heat resistance storageability and hot offset resistance.

The amount of the non-crystalline resin (B) contained in the toner is not particularly limited and may be appropriately selected depending on the intended purpose, but is preferably 60% by mass to 95% by mass, more preferably 75% by mass to 90% by mass.

<Composite Resin (C)>

The composite resin (C) contains a condensation polymerization resin unit and an addition polymerization resin unit. The composite resin (C) is a resin where the condensation polymerization resin unit and the addition polymerization resin unit are chemically bonded together (hereinafter may be referred to as "hybrid resin").

The composite resin (C) can be obtained by allowing a mixture containing a condensation polymerization monomer and an addition polymerization monomer serving as raw materials to simultaneously undergo condensation polymerization reaction and addition polymerization reaction in the same reaction vessel, or to sequentially undergo condensation polymerization reaction and addition polymerization reaction in this order, or to sequentially undergo addition polymerization reaction and condensation polymerization reaction in this order.

The condensation polymerization monomer serving as a raw material of the composite resin (C) is not particularly limited and may be appropriately selected depending on the intended purpose. Examples thereof include: polyhydric alcohols and polyhydric carboxylic acids forming polyester resin units; and polyvalent carboxylic acids, amines and amino acids forming polyamide resin units or polyester-polyamide resin units.

Examples of dihydric alcohol components among the polyhydric alcohols include 1,2-propanediol, 1,3-propanediol, ethylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained through polymerization between bisphenol A and cyclic ethers (e.g., ethylene oxide and propylene oxide).

Examples of tri- or higher-hydric alcohols among the polyhydric alcohols include sorbitol, 1,2,3,6-hexanetetrol, 1,4-sorbitan, pentaerythritol, dipentaerythritol, tripentaerythritol, 1,2,4-butanetriol, 1,2,5-pentaerythritol, glycerol, 2-methylpropanetriol, 2-methyl-1,2,4-butanetriol, trimethylolethane, trimethylolpropane and 1,3,5-trihydroxybenzene.

These may be used alone or in combination.

Among them, from the viewpoint of providing the binder resin with heat resistance storageability and mechanical strength, preferred are hydrogenated bisphenol A and alcohol components each having the bisphenol A skeleton such as diols obtained through polymerization between bisphenol A and cyclic ethers (e.g., ethylene oxide and propylene oxide).

Examples of divalent carboxylic acid components among the polyvalent carboxylic acids include: benzenedicarboxylic acids (e.g., phthalic acid, isophthalic acid and terephthalic acid) and anhydrides thereof; alkyldicarboxylic acids (e.g., succinic acid, adipic acid, sebacic acid and azelaic acid) and anhydrides thereof; unsaturated dibasic acids (e.g., maleic acid, citraconic acid, itaconic acid, alkenylsuccinic acid, fumaric acid and mesaconic acid); and unsaturated dibasic acid anhydrides (e.g., maleic anhydride, citraconic anhydride, itaconic anhydride and alkenylsuccinic anhydride).

Examples of tri- or higher-valent carboxylic acids among the polyvalent carboxylic acids include: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-haxanetricarboxylic acid, 1,3-dicarboxyl-2-methyl-2-methylenecarboxypropane, tetra(methylenecarboxy)methane, 1,2,7,8-octanetetracarboxylic acid, Enpol trimer acid; anhydrides thereof; and partial alkyl esters of thereof.

These may be used alone or in combination.

Among them, from the viewpoints of heat resistance storageability and mechanical strength of the binder resin, preferred are aromatic polyvalent carboxylic acid compounds such as phthalic acid, isophthalic acid, terephthalic acid and trimellitic acid.

Examples of the amines and the amino acids include diamines (C1), tri- or higher-valent polyamines (C2), amino alcohols (C3), aminomercaptans (C4), amino acids (C5), and amino-blocked products (C6) of the amines (C1) to (C5).

Examples of the diamines (C1) include aromatic diamines (e.g., phenylenediamine, diethyltoluenediamine and 4,4'-diaminodiphenylmethane); alicyclic diamines (e.g., 4,4'-diamino-3,3'-dimethyldicyclohexylmethane, diaminocyclohexane and isophoronediamine); and aliphatic diamines (e.g., ethylenediamine, tetramethylenediamine and hexamethylenediamine).

Examples of the tri- or higher-valent polyamines (C2) include diethylenetriamine and triethylenetetramine.

Examples of the amino alcohols (C3) include ethanolamine and hydroxyethylaniline.

Examples of the aminomercaptans (C4) include aminoethyl mercaptan and aminopropyl mercaptan.

Examples of the amino acids (C5) include aminopropionic acid, aminocaproic acid and ϵ-caprolactam.

Examples of the amino-blocked products (C6) include ketimine compounds and oxazolidine compounds derived from the amines (C1) to (C5) and ketones (e.g., acetone, methyl ethyl ketone and methyl isobutyl ketone).

The ratio by mole of the condensation polymerization monomer component in the composite resin (C) is preferably 5 mol % to 40 mol %, more preferably 10 mol % to 25 mol %.

When the ratio by mole thereof is less than 5 mol %, dispersibility of the composite resin (C) in the crystalline polyester resin (A) may be degraded. When it is more than 40 mol %, dispersibility of a releasing agent may be degraded.

Note that, a known esterification catalyst may be used in the condensation polymerization reaction.

The addition polymerization monomer in the composite resin (C) is not particularly limited and may be appropriately selected depending on the intended purpose. Examples thereof include vinyl monomers.

Examples of the vinyl monomer include styrene vinyl monomers such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-4-dichlorostyrene, m-nitrostyrene, o-nitrostyrene and p-nitrostyrene; vinyl acrylate monomers such as acrylic acid, methyl acrylate, ethyl acrylate, propyl acrylate, n-butyl acrylate, isobutyl acrylate, n-octyl acrylate and 2-ethylhexyl acrylate; vinyl methacrylate monomers such as methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate and diethylaminoethyl methacrylate; other vinyl monomers; and other monomers to form copolymers. These may be used alone or in combination.

Examples of the other vinyl monomers or the other monomers to form copolymers include: monoolefins such as ethylene, propylene, butylene and isobutylene; polyenes such as butadiene and isoprene; halogenated vinyls such as vinyl chloride, vinylidene chloride, vinyl bromide and vinyl fluoride; vinyl esters such as vinyl acetate, vinyl propionate and vinyl benzoate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; vinylnaphthalenes; acrylic or methacrylic acid derivatives such as acrylonitrile, methacrylonitrile and acrylamide; unsaturated dibasic acids such as maleic acid, citraconic acid, itaconic acid, alkenylsuccinic acid, fumaric acid and mesaconic acid; unsaturated dibasic acid anhydride such as maleic anhydride, citraconic anhydride, itaconic anhydride and alkenylsuccinic anhydride; unsaturated dibasic acid monoesters such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate and monomethyl mesaconate; unsaturated dibasic acid esters such as dimethyl maleate and dimethyl fumarate; α,β-unsaturated carboxylic acids such as crotonic acid and cinnamic acid; α,β-unsaturated carboxylic anhydride such as crotonic anhydride and cinnamic anhydride; carboxyl group-containing monomers such as acid anhydrides formed between α,β-unsaturated carboxylic acids and lower fatty acids; and acid anhydrides and monoesters of alkenylmalonic acid, alkenylglutaric acid and alkenyladipic acid; hydroxyalkyl(meth)acrylate such as 2-hydroxyethyl(meth)acrylate and 2-hydroxypropyl methacrylate; and hydroxy group-containing monomers such as 4-(1-hydroxy-1-methylbutyl)styrene and 4-(1-hydroxy-1-methylhexyl)styrene. These may be used alone or in combination.

Among them, styrene, acrylic acid, n-butyl acrylate, 2-ethylhexyl acrylate, methacrylic acid, n-butyl methacrylate and 2-ethylhexyl methacrylate are suitably used. When they are used in combination with at least styrene and acrylic acid, dispersibility of a releasing agent is remarkably excellent, which is particularly preferred.

If necessary, a crosslinking agent for the addition polymerization monomer may be used in the production of the composite resin (C).

The crosslinking agent is not particularly limited and may be appropriately selected depending on the intended purpose. Examples thereof include: aromatic divinyl compounds; diacrylate compounds having an alkyl chain as a linking moiety; diacrylate compounds having, as a linking moiety, an alkyl chain containing an ether bond; and polyester diacrylates.

Examples of the aromatic divinyl compounds include divinyl benzene and divinyl naphthalene.

Examples of the diacrylate compounds having an alkyl chain as a linking moiety include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and methacrylate compounds where the acrylates of the above-listed compounds are changed to methacrylates.

Examples of the diacrylate compounds having, as a linking moiety, an alkyl chain containing an ether bond include: diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and methacrylate compounds where the acrylates of the above-listed compounds are changed to methacrylates.

Further examples include di(meth)acrylate compounds having a linking moiety containing an aromatic group or ether bond.

Examples of the polyester diacrylates include MANDA (trade name) (product of NIPPON KAYAKU CO., LTD.).

Examples of multifunctional crosslinking agents include pentaerythritol triacrylate, trimethylolethane triacrylate, trimethylolpropane triacrylate, tetramethylolmethane tetraacrylate, oligoester acrylate, methacrylate compounds where the acrylates of the above-listed compounds are changed to methacrylates, triallyl cyanurate and triallyl trimellitate.

The amount of the crosslinking agent is not particularly limited and may be appropriately selected depending on the intended purpose, but is preferably 0.01 parts by mass to 10 parts by mass, more preferably 0.03 parts by mass to 5 parts by mass, per 100 parts by mass of the addition polymerization monomer used.

A polymerization initiator used in polymerizing the addition polymerization monomer is not particularly limited and may be appropriately selected depending on the intended purpose. Examples thereof include: azo polymerization initiators such as 2,2'-azobisisobutylonitrile, 2,2'-azobis(4-methoxy-2,4-dimethylvaleronitrile) and 2,2'-azobis(2,4-dimethylvaleronitrile); and peroxide polymerization initiators such as methyl ethyl ketone peroxide, acetylacetone peroxide, 2,2-bis(tert-butylperoxy)butane, tert-butyl hydroperoxide, benzoyl peroxide and n-butyl-4,4-di-(tert-butylperoxy) valeate.

These may be used alone, or may be used in combination for the purpose of adjusting the resin in terms of molecular weight and molecular weight distribution.

The amount of the polymerization initiator is not particularly limited and may be appropriately selected depending on the intended purpose, but is preferably 0.01 parts by mass to 15 parts by mass, more preferably 0.1 parts by mass to 10 parts by mass, per 100 parts by mass of the addition polymerization monomer.

In order to chemically binding the condensation polymerization resin unit with the addition polymerization resin unit, for example, it is possible to use a monomer reactive in both condensation polymerization and addition polymerization (i.e., a condensation-addition polymerization-reactive monomer).

Examples of the condensation-addition polymerization-reactive monomer include unsaturated carboxylic acids such as acrylic acid and methacrylic acid; unsaturated dicarboxylic acids such as fumaric acid, maleic acid, citraconic acid and itaconic acid, and anhydrides thereof; and vinyl monomers containing a hydroxyl group.

The amount of the condensation-addition polymerization-reactive monomer is not particularly limited and may be appropriately selected depending on the intended purpose, but is preferably 1 part by mass to 25 parts by mass, more preferably 2 parts by mass to 20 parts by mass, per 100 parts by mass of the addition polymerization monomer used.

When the composite resin (C) is produced in the same reaction vessel, both the condensation polymerization reaction and the addition polymerization reaction are allowed to proceed and/or complete at the same time. Alternatively, both the reactions can be completed independently by selecting the reaction temperature and time for each of the reactions.

In one exemplary method, a mixture of the addition polymerization monomer and the polymerization initiator is dropped to the mixture of the condensation polymerization monomer in the reaction vessel, followed by mixing in advance. After that, the addition polymerization is first completed through radical polymerization reaction, and then the condensation polymerization is allowed to proceed by raising the reaction temperature.

In this manner, when two independent reactions are allowed to proceed in the reaction vessel, two different kinds of resin units can be effectively dispersed or bound together.

The composite resin (C) is preferably a composite resin containing a polyester resin unit as the condensation polymerization resin unit and a vinyl resin as the addition polymerization resin unit. The combination of these units allows the composite resin (C) to exhibit its function effectively.

The softening temperature (T1/2c) of the composite resin (C) is not particularly limited and may be appropriately selected depending on the intended purpose, but is preferably 90° C. to 130° C., more preferably 100° C. to 120° C.

When the softening temperature (T1/2c) thereof is lower than 90° C., there may be degradation in heat resistance storageability and hot offset resistance. When it is higher than 130° C., there may be degradation in low-temperature fixing property.

Also, the glass transition temperature (Tgc) of the composite resin (C) is preferably 50° C. to 80° C., more preferably 55° C. to 70° C., from the viewpoints of fixing property, storageability and durability.

Note that, the Tgc and the T1/2c can be measured in the same manner as in the Tga and the T1/2a.

The acid value of the composite resin (C) is not particularly limited and may be appropriately selected depending on the intended purpose, but is preferably 5 mgKOH/g to 80 mgKOH/g, more preferably 15 mgKOH/g to 40 mgKOH/g, from the viewpoints of chargeability and environmental stability. Note that, the acid value can be measured by the method according to JIS K-0070.

The amount of the composite resin (C) in the toner is not particularly limited and may be appropriately selected depending on the intended purpose, but is preferably 3% by mass to 20% by mass.

<Colorant>

The colorant is not particularly limited and may be appropriately selected from conventionally known dyes and pigments depending on the intended purpose. Examples thereof include carbon black, lamp black, iron black, aniline blue, phthalocyanine blue, phthalocyanine green, Hansa yellow G, rhodamine 6C lake, Calco Oil Blue, chrome yellow, quinacridone, Benzidine Yellow, rose Bengal and triallymethane dyes. These may be used alone or in combination.

The toner of the present invention can be used as a black toner or a full color by using the colorant.

Carbon black among the colorants has a particularly excellent black-coloring ability and also has a good electroconductivity. Hence, when the amount of carbon black is large or exists in an aggregated state in the toner, the toner is decreased in electrical resistance to cause transfer failures in a transfer step. In particular, when used in combination with the crystalline polyester resin (A), carbon black particles cannot enter domains of the crystalline polyester resin (A). As a result, when the crystalline polyester resin (A) present in the toner has a large dispersion diamete, the carbon black particles exists in the other resins than the crystalline polyester resin (A) at a relatively high concentration. Therefore, it is easy for the carbon black to be confined as aggregates in the toner, so that the resistance of the toner tends to decrease excessively.

In the present invention, since the composite resin (C) is used in combination, dispersibility of carbon black becomes good, making it possible to reduce the above-described risks. When the toner is fixed on a recording medium, carbon black can increase the viscosity of the melted toner. Thus, when the non-crystalline resin (B) is used in a large amount, carbon black can exhibit an effect of suppressing hot offset occurring due to a decrease in viscosity.

The amount of the colorant is not particularly limited and may be appropriately selected depending on the intended purpose, but is generally 1% by mass to 30% by mass, preferably 3% by mass to 20% by mass, relative to the amount of the resin components of the toner.

<Other Ingredients>

If necessary, the toner of the present invention may further contain other ingredients such as a charge-controlling agent, a fatty acid amide compound, a releasing agent and an external additive.

<<Charge-Controlling Agent>>

The charge-controlling agent is not particularly limited and may be appropriately selected depending on the intended purpose. Examples thereof include: nigrosine and its modified products with fatty acid metal salts, onium salts (e.g., phosphonium salts) and lake pigments thereof; triphenylmethane dyes and lake pigments thereof, and metal salts of higher fatty acids; diorganotinoxides such as dibutyltinoxide, dioctyltinoxide and dicyclohexyltinoxide; and diorganotinborates such as dibutyltinborate, dioctyltinborate and dicyclohexyltinborate, organometallic complexes, chelate compounds, monoazo metal complexes, acetylacetone metal complexes, aromatic hydroxycarboxylic acid, metal complexes of aromatic dicarboxylic acids, quaternary ammonium salts and salicylic acid metal compounds. Further examples include aromatic hydroxycarboxylic acids, aromatic mono- or polycarboxylic acids, metal salts thereof, anhydrides thereof, esters thereof, and phenol (e.g., bisphenol) derivatives thereof. These may be used alone or in combination.

The amount of the charge-controlling agent is not particularly limited and may be appropriately selected depending on the intended purpose, but is preferably 0.1 parts by mass to 10 parts by mass, more preferably 1 part by mass to 5 parts by mass, relative to the amount of the resin components of the toner.

Among these charge-controlling agents, use of salicylic acid metal compounds alone or in combination is preferred from the viewpoint of improving hot offset resistance also. In particular, a complex containing a tri- or higher-valent metal able to form a 6-coordinate structure reacts with a resin and a high-reactive moiety of a wax to form a mild crosslinked structure, to thereby greatly contribute to hot offset resistance. When used in combination with the composite resin (C), their dispersibility is improved to allow the charge-controlling agent to exhibit its function of controlling charging polarity more effectively.

Here, the tri- or higher-valent metal is not particularly limited and may be appropriately selected depending on the intended purpose. Examples thereof include Al, Fe, Cr and Zr.

The salicylic acid metal compounds usable are, for example, compounds represented by the following General Formula (2). Examples thereof include BONTRON E-84 (product of Orient Chemical Industries, Ltd.) where M is zinc in General Formula (2).

[General Formula (2)]

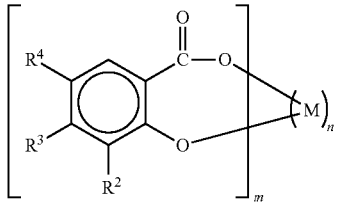

In General Formula (2), $R^2$, $R^3$ and $R^4$ each independently represent a hydrogen atom, a linear or branched C1-C10 alkyl group or a linear or branched C2-C10 alkenyl group, M is chrome, zinc, calcium, zirconium or aluminum, m is an integer of 2 or greater, and n is an integer of 1 or greater.

<<Fatty Acid Amide Compound>>

The toner of the present invention preferably contains a fatty acid amide compound.

When a crystalline polyester resin and a fatty acid amide compound are added to a pulverized toner produced through a process containing a melt-kneading step, recrystallization of the crystalline polyester resin which has melted in the kneading is promoted in the kneaded product upon cooling, resulting in less compatibility with the resin. As a result, it is possible to suppress a decrease in glass transition temperature of the toner and improve heat resistance storageability. When used in combination with the below-described releasing agent, the fatty acid amide compound makes it possible to stay the releasing agent in the surface of a fixed image. The fixed image can be increased in resistance to rubbing (improvement in smear resistance).

The amount of the fatty acid amide compound in the toner is preferably 0.5% by mass to 10% by mass.

The fatty acid amide compound is not particularly limited and may be appropriately selected depending on the intended purpose. Examples thereof include compounds represented by the following General Formula (I) or General Formula (II).

$$R_1—CO—NR_2R_3 \qquad \text{General Formula (I)}$$

In General Formula (I), $R_1$ represents a C10-C30 aliphatic hydrocarbon group, and $R_2$ and $R_3$ each independently a hydrogen atom, a C1-C10 alkyl group, a C6-C10 aryl group or a C7-C10 aralkyl group.

General Formula (II)

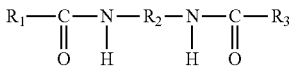

In General Formula (II), $R_1$ and $R_3$ each independently represent a C5-C21 alkyl group or alkenyl group, and $R_2$ represents a C1-C20 alkylnen group.

Among them, particularly preferred is an alkylene bis fatty acid amide represented by General Formula (II).

Here, each of the alkyl group, the aryl group and the aralkyl group represented by $R_2$ or $R_3$ in General Formula (I) may have a generally inert substituent such as a fluorine atom, a chlorine atom, a cyano group, an alkoxy group or an alkylthio group, but preferably have no substituent.

Examples of the compounds represented by General Formula (I) include stearic acid amide, stearic acid methylamide, stearic acid diethylamide, stearic acid benzylamide, stearic acid phenylamide, behenic acid amide, behenic acid dimethylamide, myristic acid amide and palmitic acid amide. These may be used alone or in combination.

Examples of the alkylene bis saturated fatty acid amide represented by General Formula (II) include methylene bisstearic acid amide, ethylene bisstearic acid amide, methylene bispalmitic acid amide, ethylene bispalmitic acid amide, methylene bisbehenic acid amide, ethylene bisbehenic acid amide, hexamethylene bisstearic acid amide, hexaethylene bispalmitic acid amide and hexamethylene bisbehenic acid amide. These may be used alone or in combination. Among them, ethylene bisstearic acid amide is particularly preferred.

Examples of other usable alkylene bis fatty acid amide compounds include alkylene bis fatty acid amides of saturated or mono- or diunsaturated fatty acids such as propylene bisstearic acid amide, butylene bisstearic acid amide, methylene bisoleic acid amide, ethylene bisoleic acid amide, propylene bisoleic acid amide, butylene bisoleic acid amide, methylene bislauric acid amide, ethylene bislauric acid amide, propylene bislauric acid amide, butylene bislauric acid amide, methylene bismyristic acid amide, ethylene bismyristic acidamide, propylene bismyristic acidamide, butylene bismyristic acidamide, propylene bispalmitic acid amide, butylene bispalmitic acid amide, methylene bispalmitoleic acid amide, ethylene bispalmitoleic acid amide, propylene bispalmitoleic acid amide, butylene bispalmitoleic acid amide, methylene bisarachidic acid amide, ethylene bisarachidic acid amide, propylene bisarachidic acid amide, butylene bisarachidic acid amide, methylene biseicosenoic acid amide, ethylene biseicosenoic acid amide, propylene biseicosenoic acid amide, butylene biseicosenoic acid amide, methylene bisbehenic acid amide, ethylene bisbehenic acid amide, propylene bisbehenic acid amide, butylene bisbehenic acid amide, methylene biserucic acid amide, ethylene biserucic acid amide, propylene biserucic acid amide and butylene biserucic acid amide.

Note that, these fatty acid amide compounds can also play a role as a releasing agent on the surface of a fixing member when their softening temperature (T1/2) is lower than the surface temperature of the fixing member upon fixing.

<<Releasing Agent>>

The releasing agent is not particularly limited and may be appropriately selected from conventionally known ones depending on the intended purpose. Examples thereof include: low-molecular-weight polyolefin wax such as low-molecular-weight polyethylenes and low-molecular-weight polypropylenes; synthetic hydrocarbon wax such as Fischer-Tropsch wax; natural wax such as beeswax, carnauba wax, candelilla wax, rice wax and montan wax; petroleum wax such as paraffin wax and microcrystalline wax; higher fatty acids such as stearic acid, palmitic acid and myristic acid, metal salts thereof and amides thereof; synthetic ester wax; and various modified wax thereof. These may be used alone or in combination.

Among them, preferred are carnauba wax and a modified wax thereof, polyethylene wax, and synthetic ester wax. Carnauba wax is particularly preferred since it is properly finely dispersed in a polyester resin or a polyol resin, to make it easy to form a toner excellent in all of hot offset resistance, transferability and durability.

When used in combination with a fatty acid amide compound, the releasing agent results to have an increased effect of staying on the surface of a fixed image, leading to further improvement in smear resistance.

The amount of the releasing agent is not particularly limited and may be appropriately selected depending on the intended purpose, but is preferably 2% by mass to 15% by mass relative to the amount of the toner. When the amount thereof is less than 2% by mass, there may be a case where hot offset-preventing effect is not sufficient. When it is more than 15% by mass, there may be a case where transferability and durability decrease.

The melting point of the releasing agent is not particularly limited and may be appropriately selected depending on the intended purpose, but is preferably 70° C. to 150° C. When the melting point is lower than 70° C., the toner may be degraded in heat resistance storageability. When it is higher than 150° C., the releasing agent cannot sufficiently exhibit its releasing property in some cases.

Note that, the melting point can be measured using, for example, a differential scanning calorimeter (DSC-60, product of Shimadzu Corporation, Ltd.).

<<External Additive>>

The toner preferably contains an external additive.

The external additive is not particularly limited and may be appropriately selected depending on the intended purpose, but is preferably an inorganic compound having an average primary particle diameter of 40 nm to 160 nm.

The inorganic compound is not particularly limited and may be appropriately selected depending on the intended purpose. Examples thereof include inorganic oxides. Examples of the inorganic oxides include silica, titanium oxide and aluminum oxide.

The average primary particle diameter thereof is preferably 40 nm to 160 nm, more preferably 50 nm to 150 nm. When the average primary particle diameter thereof is less than 40 nm, the external additive may tend to be embedded in the toner during intermediate transfer. When it is more than 160 nm, the toner may be degraded in low-temperature fixing property.

The average primary particle diameter can be determined as follows. Specifically, the external additives are photographed with an electron microscope. The obtained image is used to calculate the average primary particle diameter from the particle diameters and the number of the external additives present in the image.

The amount of the external additive in the toner is not particularly limited and may be appropriately selected depending on the intended purpose, but is preferably 0.2 parts by mass to 5.0 parts by mass.

<Chloroform Insoluble Matter in the Toner>

The toner of the present invention contains chloroform insoluble matter in an amount of 1% by mass to 30% by mass, preferably 2% by mass to 20% by mass, more preferably 3% by mass to 20% by mass. When the chloroform insoluble matter thereof is less than 1% by mass, there is a less degree of hot offset resistance attributed to the chloroform insoluble matter. When it is more than 30% by mass, the amount of the binder resin that contributes to the low-temperature fixing property is relatively low, leading to degradation in low-temperature fixing property.

The chloroform insoluble matter of the toner is measured as follows.

About 1.0 g of the toner is weighed, and about 50 g of chloroform is added to the toner, followed by thoroughly dissolving. The resultant solution is subjected to centrifugal separation, and the resultant product is filtrated at normal temperature using a qualitative filter paper of class 5C of JIS (P3801). The residue on the filter paper is the insoluble matter. The amount of the chloroform insoluble matter is expressed as a ratio (% by mass) of the mass of the residue on the filter paper to the mass of the toner used. Note that, since the residue on the filter paper contains solid products such as a pigment, the chloroform insoluble matter of the toner is separately measured through thermal analysis also.

<Endothermic Peak of the Toner and its Endothermic Amount>

The toner of the present invention has an endothermic peak in a range of 90° C. to 130° C. in measurement through DSC. The endothermic peak is preferably an endothermic peak attributed to the crystalline polyester resin (A). When the endothermic peak attributed to the crystalline polyester resin (A) falls within a range of 90° C. to 130° C., the crystalline polyester resin does not melt at normal temperature, and the toner melts in a fixing temperature region, which is a relatively low temperature range, to be fixed on a recording medium, so that it is possible for the toner to more effectively exhibit heat resistance storageability and low-temperature fixing property.

The endothermic amount of the endothermic peak is not particularly limited and may be appropriately selected depending on the intended purpose, but is preferably 1 J/g to 15 J/g. When the endothermic amount thereof is less than 1 J/g, the amount of the crystalline polyester resin (A) that effectively acts in the toner is so small that the crystalline polyester resin (A) may not exhibit its function sufficiently. When it is more than 15 J/g, the amount of the crystalline polyester resin (A) that effectively acts in the toner is so large that the absolute amount of the crystalline polyester resin (A) compatible with the non-crystalline resin (B) and the composite resin (C) becomes larger. As a result, the toner is decreased in glass transition temperature and hence may be decreased in heat resistance storageability.

The DSC for measuring the endothermic peak in the present invention is performed by raising the temperature of the toner at 10° C./min from 20° C. to 150° C. using a differential scanning calorimeter ("DSC-60"; product of Shimadzu Corporation, Ltd.).

In the present invention, the endothermic peak attributed to the crystalline polyester resin is present in a range of 80° C. to 130° C. or thereabout within which the melting point of the crystalline polyester resin (A) falls. The endothermic amount is determined from the area of a range defined by a baseline and an endothermic curve. In general, the endothermic amount in DSC is often measured by raising the temperature twice. However, the endothermic peak in the present invention is determined from an endothermic curve at the first temperature raising.

When the endothermic peak attributed to the crystalline polyester resin (A) is overlapped with the endothermic peak of a wax, the endothermic amount of the wax is subtracted from the endothermic amount of the overlapped peak. The endothermic amount of the wax is calculated from the amount of the wax in the toner and the endothermic amount of the wax alone.

<Molecular Weight Distribution of the Toner>

The toner of the present invention has a molecular weight distribution having a main peak in a range of 1,000 to 10,000 and a half width of 15,000 or less, where the molecular weight distribution is obtained through gel permeation chromatography (GPC) of tetrahydrofuran (THF) soluble matter of the toner. Preferably, the molecular weight distribution obtained through gel permeation chromatography (GPC) of THF soluble matter of the toner has a main peak in a range of 1,200 to 9,000 and a half width of 14,000 or less.

The GPC is performed in the following manner. Specifically, a column is conditioned in a heat chamber of 40° C., and then tetrahydrofuran (THF) as a solvent is caused to pass through the column of the same temperature at a flow rate of 1 mL/min. Subsequently, a separately prepared THF solution of a toner sample (concentration: 0.05% by mass to 0.6% by mass) is applied to the column in an amount of 50 μL to 200 μL.

In the measurement of the molecular weight of the toner (sample), the molecular weight distribution is determined based on the relationship between the logarithmic value and the count number of a calibration curve given by using several monodispersed polystyrene-standard samples.

The monodispersed polystyrene-standard samples used for giving the calibration curve may be, for example, those available from Pressure Chemical Co. or Tosoh Co. each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. It is proper to use at least about 10 monodispersed polystyrene-standard samples for giving the calibration curve. The detector to be used is a refractive index (RI) detector.

<Particle Diameter of Toner>

The particle diameter of the present invention is not particularly limited and may be appropriately selected depending on the intended purpose. A volume average particle diameter of the toner is preferably 4 μm to 10 μm from the viewpoint of obtaining a high-quality image excellent in, for example, thin line reproducibility. When the volume average particle diameter thereof is less than 4 μm, there are failures in cleaning property in a developing step and transfer efficiency in a transfer step, so that image quality may be degraded. When the volume average particle diameter thereof is more than 10 μm, the formed image may be degraded in thin line reproducibility.

The volume average particle diameter of the toner can be measured by various methods. For example, it can be measured using COULTER COUNTER TAII (product of U.S. COULTER ELECTRONICS Co.).

<Method for Producing Toner>

The toner of the present invention is produced by, for example, a pulverization method or a polymerization method.

The polymerization method is not particularly limited and may be appropriately selected from conventionally known methods depending on the intended purpose. Examples thereof include a suspension polymerization method, a dissolution suspension method, an emulsion aggregation method and an ester extension method.

The pulverization method includes at least a melt-kneading step and a pulverizing step; and, if necessary, further includes other steps such as a cooling step and a classifying step. Specifically, it is a method where toner materials including the crystalline polyester resin (A), the non-crystalline resin (B), the composite resin (C) and the colorant are mixed together in a dry process; and the resultant mixture is melt-kneaded using a kneader and pulverized to thereby obtain a pulverized toner.

The melt-kneading step is a step of melt-kneading a mixture of the above toner materials. Examples of the kneader used in the melt-kneading step include uniaxial or biaxial continuous kneaders and batch kneaders using a roll mill. Specific examples thereof include a KTK-type biaxial extruder (product of KOBE STEEL, Ltd.), a TEM-type extruder (product of TOSHIBA MACHINE CO., LTD.), a biaxial extruder (product of KCK Co., Ltd.), a PCM-type biaxial extruder (product of IKEGAI LTD.) and a co-kneader (product of BUSS Company). Preferably, the melt-kneading is performed under appropriate conditions so as not to cleave the molecular chains of the binder resin. The temperature during the melt-kneading is determined in consideration of the softening point of the binder resin. Specifically, when the temperature is higher than the softening point, cleavage of the molecular chains occurs to a considerable extent; whereas when the temperature is lower than the softening point, a sufficient dispersion state is difficult to attain.

The pulverizing step is a step of pulverizing the kneaded product obtained in the melt-kneading step. In this pulverization, the kneaded product is roughly pulverized and then finely pulverized. Examples of pulverizing manner preferably used include a manner in which the kneaded product is crushed against a collision plate under a jet stream for pulverization, a manner in which the kneaded particles are crushed one another under a jet stream for pulverization, and a manner in which the kneaded product is pulverized by passage through the narrow gap between a mechanically rotating rotor and a stator.

The classification step is a step of classifying the pulverized product obtained in the pulverization step. With this step, the pulverized product (toner) is classified to prepare particles having a predetermined particle diameter. This classification is performed by removing microparticles using, for example, a cyclone, a decanter or a centrifugal separator.

After completion of the above pulverization and classification, the obtained pulverized product is classified in a gas flow by the action of centrifugal force, whereby toner particles having a predetermined particle diameter can be produced.

The method of the present invention for producing a toner preferably includes a cooling step between the melt-kneading step and the pulverizing step. The cooling step is a step of cooling the kneaded product obtained in the melt-kneading step. In the cooling step, when the average thickness of the kneaded product is 2.5 mm or greater, the cooling rate of the kneaded product becomes slow, extending the time for re-crystallization of the crystalline polyester resin (A) which has been melted in the kneaded product. In order to promote re-crystallization, it is also effective to formulate a fatty acid amide compound as described above, but the same effect may be achieved by adjusting the production process. An upper limit of the average thickness of the kneaded product is not particularly limited and may be appropriately selected depending on the intended purpose. The average thickness thereof is preferably 8 mm or smaller since the average thickness exceeding 8 mm considerably reduces efficiency in pulverization in the subsequent pulverization step. Note that, a method for measuring the above average thickness is not particularly limited. Any conventionally known method for measuring a thickness may be used to measure the thicknesses of the kneaded product and then the obtained measurements may be averaged to determine the average thickness thereof.

In order to improve the toner in flowability, storageability, developability and transferability, the method for producing the toner may further include an external additive mixing step of adding to and mixing with the above-produced toner (toner base particles) an external additive such as hydrophobic silica powder.

A mixer usable in the external additive mixing step is not particularly limited and may be a known device so long as it can mix powder. Examples thereof include a V-shaped mixer, a locking mixer, LOEDIGE MIXER, NAUTOR MIXER and HENSHEL MIXER. Preferred is a mixer having a jacket to control the internal temperature thereof.

In order to change a loading applied to the external additive, the external additive may be added gradually or during mixing, or the rotation number and rolling speed of the mixer, and the mixing time and the mixing temperature may be appropriately changed. A high loading may first be applied thereto and then a relatively low loading may be applied thereto, and vice versa.

Note that, after the external additive mixing step, the product may be caused to pass through a sieve having an opening of 250 mesh or greater to remove coarse particles and aggregated particles.

(Developer)

A developer of the present invention contains the toner of the present invention. The developer is not particularly limited, and may be a one-component developer containing only the toner or a two-component developer containing a carrier as well as the toner. For use in, for example, high-speed printers responding to the recent improvement in information processing speed, the toner is preferably used as a two-component developer from the viewpoint of improvement in service life.

The type and the amount of the carrier are not particularly limited and may be appropriately selected depending on the intended purpose.

(Image Forming Method and Image Forming Apparatus)

An image forming apparatus of the present invention includes: an electrophotographic photoconductor; a charging unit; an exposing unit; a developing unit; and a transferring unit; and, if necessary, further includes appropriately selected other units such as a fixing unit, a cleaning unit, a charge-eliminating unit, a recycling unit and a controlling unit.

An image forming method of the present invention includes: a charging step; an exposing step; a developing step; and a transfer step; and, if necessary, further includes appropriately selected other steps such as a fixing step, a cleaning step, a charge-eliminating step, a recycling step and a controlling step.

The image forming method of the present invention can suitably be performed by the image forming apparatus of the present invention. The charging step can be performed by the charging unit. The exposing step can be performed by the exposing unit. The developing step can be performed by the developing unit. The transfer step can be performed by the transferring unit. The other steps can be performed by the other units.

<Charging Step and Charging Unit>

The charging step is a step of charging a surface of the electrophotographic photoconductor and is performed by the charging unit.

The charging unit is not particularly limited and may be appropriately selected depending on the intended purpose so long as it is a unit configured to charge a surface of the electrophotographic photoconductor. The charging unit is preferably a non-contact type charging unit configured to charge the electrophotographic photoconductor in a non-contact manner.

Examples of the non-contact type charging unit include a non-contact type charger utilizing corona discharge, a needle electrode device, a solid discharge element; and an electroconductive or semielectroconductive charging roller disposed while keeping a microgap with respect to the electrophotographic photoconductor. Among them, a charger utilizing corona discharge is particularly preferred.

The corona discharge method is a non-contact charging method which gives positive or negative ions generated by corona discharge in an air to the surface of an electrophotographic photoconductor. Examples of the charger based on this method include: a corotron charger having properties capable of giving a certain charge amount to an electrophotographic photoconductor; and a scorotron charger having properties capable of giving a certain electrical potential.

The corotron charger is composed of a casing electrode which occupies a half space around a discharge wire and of a discharge wire placed near the center of the casing electrode.

The scorotron charger is the same as the corotron charger except that it further contains a grid electrode. The grid electrode is disposed at a position which is 1.0 mm to 2.0 mm away from the surface of the electrophotographic photoconductor.

<Exposing Step and Exposing Unit>

The exposure can be performed by, for example, image-wise exposing the surface of the electrophotographic photoconductor to light using the exposing unit.

An optical system in the exposure is roughly classified into an analog optical system (analog mode) and a digital optical system (digital mode). The analog optical system is an optical system in which a manuscript is directly projected on an electrophotographic photoconductor, while the digital optical system is an optical system in which image information given as electrical signals is converted into light signals on which an electrophotographic photoconductor is exposed to light to form an image.

The exposing unit is not particularly limited and may be appropriately selected depending on intended purpose so long as it is configured to expose the charged surface of the electrophotographic photoconductor to light to thereby form a latent electrostatic image. Examples thereof include various exposing devices such as copying optical systems, rod lens array systems, laser optical systems, liquid crystal shutter optical systems and LED optical systems. Among them, the exposing unit is preferably a unit containing a semiconductor laser, light-emitting diode, or both thereof and configured to digitally form a latent electrostatic image on the electrophotographic photoconductor.

In the present invention, a rear light system which performs imagewise exposing from the back side of the electrophotographic photoconductor may be employed.

<Developing Step and Developing Unit>

The developing step is a step of developing the latent electrostatic image with a toner or a developer to from a visible image.

The visible image can be formed by, for example, developing the latent electrostatic image with the toner or developer using the developing unit.

The developing unit is not particularly limited and may be appropriately selected depending on the intended purpose so long as it is configured to develop the latent electrostatic image with a toner to thereby form a visible image. Examples thereof include a developing unit housing the toner or developer therein and containing a developing device capable of applying the toner or developer to the latent electrostatic image in a contact or non-contact manner.

The toner is the toner of the present invention.

The developing device may be one using a dry developing process or a wet developing process. Also, the developing device may be a single-color developing device or a multicolor developing device. Examples of the developing device suitably used include a developing device containing: a stirrer which charges the toner or developer by frictional stirring; and a rotatable magnet roller.

In the developing device, for example, the toner and the carrier are mixed together under stirring, and the toner is charged by friction upon mixing under stirring and is retained on the surface of the rotating magnet roller in a chain-like form to thereby form a magnetic brush. Since the magnet roller is disposed in the vicinity of the electrophotographic photoconductor (photoconductor), a portion of the toner, which constitutes the magnetic brush formed on the surface of the magnet roller, moves to the surface of the electrophotographic photoconductor by an electrically attractive force. As a result, the latent electrostatic image is developed with the toner to form a visible image made of the toner on the surface of the electrophotographic photoconductor.

<Transferring Step and Transferring Unit>

The transferring step is a step of transferring the visible image onto a recording medium. In this step, preferably, the visible images are primarily transferred to an intermediate transfer member, and the thus-transferred visible images are secondarily transferred onto a recording medium. Also, toners of two or more colors are used (a full color toner is preferably used). More preferably, the transferring step includes: a primary-transferring step of forming a composite image by transferring the visible images to the intermediate member; and a secondary-transferring step of transferring the transferred composite image to a recording medium.

For example, the visible image can be transferred by charging the electrophotographic photoconductor with a transfer charger using the transferring unit.

The transferring unit is not particularly limited and may be appropriately selected depending on the intended purpose so long as it is a unit configured to transfer a visible image to a recording medium. Preferably, the transferring unit includes: a primary-transferring unit configured to form a composite image by transferring the visible images to an intermediate member; and a secondary-transferring unit configured to transfer the transferred composite image to a recording medium.

Note that, the intermediate transfer member is not particularly limited and can be appropriately selected from known transfer members depending on the intended purpose. Examples of the intermediate transfer members suitably used include a transferring belt.

A material of the intermediate transfer member is not particularly limited and may be appropriately selected depending on the intended purpose. Examples thereof include polyethylene terephthalate (PET), ethylene-tetrafluoroethylene copolymer (ETFE), polyvinylidene fluoride (PVDF) and polyimides. Among them, polyimides are preferred in terms of electroconductivity and durability.

The intermediate transfer member is preferably an intermediate transfer belt of a shape of belt in terms of layout.

A surface of the intermediate transfer member may be treated with, for example, a fluororesin or an acryl resin. Also, the intermediate transfer member may contain, for example, carbon black and/or titanium dioxide.

The transferring unit (consisting of the primary- and secondary-transferring units) preferably includes at least a transferring device which charges the visible images and transfers them from the electrophotographic photoconductor onto the recording medium. The number of the transferring units may be one or two or more. Examples of the transferring device include a corona transferring device employing corona discharge, a transfer belt, a transfer roller, a pressing transfer roller and an adhesive transferring device.

The recording medium is not particularly limited and may be appropriately selected depending on the intended purpose so long as it can receive a developed, unfixed image. Examples of the recording medium include plain paper and a PET base for OHP. Typically, plain paper is used.

<Other Steps and Other Units>

—Fixing Step and Fixing Unit—

The fixing step is a step of fixing, with a fixing device, the visible image on the recording medium which has been transferred to the recording medium. The fixing step may be performed every after a toner image of each color is transferred onto the recording medium; or may be performed at one time after toner images of all colors are superposed on top of one another on the recording medium.

The fixing unit is not particularly limited and may be appropriately selected depending on the intended purpose. Examples thereof include a fixing unit containing a fixing device and a heat source for heating the fixing device.

Examples of the fixing unit include: a combination of an endless belt and a roller; and a combination of a roller and another roller. Preferred is a combination of an endless belt and a roller each having a small heat capacity from the viewpoints of shortening the warming-up time, realizing energy saving, and extending a fixable range.

—Charge-Eliminating Step and Charge-Eliminating Unit—

The charge-eliminating step is a step of eliminating charges by applying a charge-eliminating bias to the electrophotographic photoconductor, and can suitably be performed by the charge-eliminating unit.

The charge-eliminating unit is not particularly limited and may be appropriately selected from known charge-eliminating devices so long as it can apply a charge-eliminating bias to the electrophotographic photoconductor. Preferably, a charge-eliminating lamp or a similar device is used.

—Cleaning Step and Cleaning Unit—

The cleaning step is a step of removing the toner remaining on the electrophotographic photoconductor, and can suitably be performed by the cleaning unit. Note that, in one employable method without using a cleaning unit, the charges of the residual toner are made uniform using a sliding member and the thus-treated toner is recovered by a developing roller.

The cleaning unit is not particularly limited and may be appropriately selected from known cleaners so long as it can remove the electrophotographic toner remaining on the electrophotographic photoconductor. Examples of the cleaning unit suitably used include a magnetic blush cleaner, an electrostatic brush cleaner, a magnetic roller cleaner, a blade cleaner, a brush cleaner and a web cleaner.

—Recycling Step and Recycling Unit—

The recycling step is a step of recycling the toner removed in the cleaning step to the developing unit, and can suitably be performed by the recycling unit.

The recycling unit is not particularly limited and may be, for example, a known conveying unit.

—Controlling Step and Controlling Unit—

The controlling step is a step of controlling each of the above steps, and can suitably be performed by the controlling unit.

The controlling unit is not particularly limited and may be appropriately selected depending on the purpose so long as it can control the operation of each unit. Examples thereof include devices such as sequencers and computers.

Referring to the drawings, the image forming method and the image forming apparatus of the present invention will next be described in detail.

Figure 3:
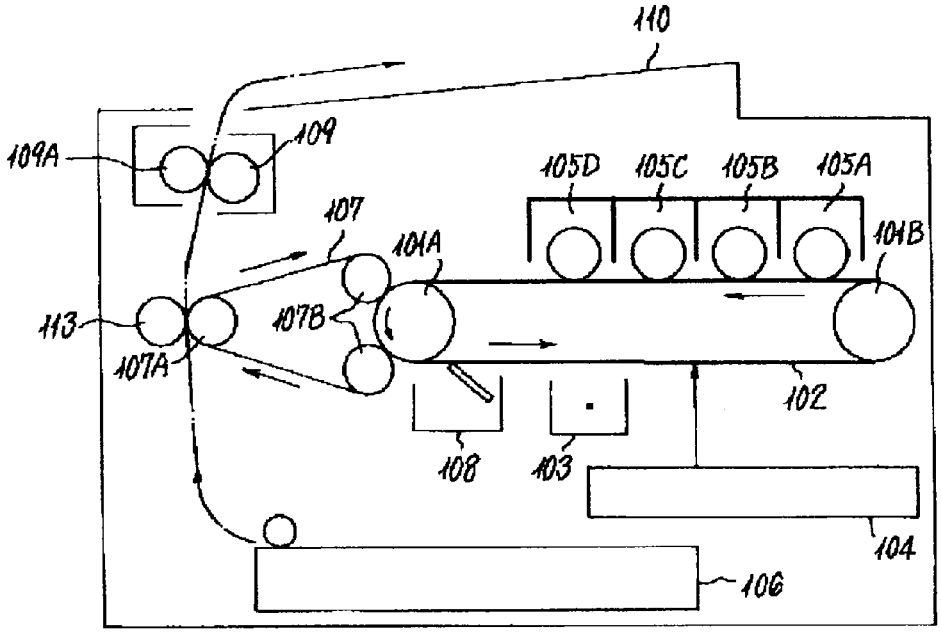
FIG. 3 schematically illustrates one example of an image forming apparatus of the present invention.

One example of the image forming apparatus of the present invention is illustrated in FIG. 3

In FIG. 3, 101A denotes drive roller; 101B denotes a driven roller; 102 denotes a photoreceptor belt; 103 denotes a charger; 104 denotes a laser writing unit, 105A to 105D denote development units which accommodate yellow, magenta, cyan and black toners, respectively; 106 denotes a paper cassette; 107 denotes an intermediate transfer belt; 107A denotes a roller drive shaft for driving the intermediate transfer belt; 107B denotes a driven shaft roller to support the intermediate transfer belt; 108 denotes a cleaning device; 109 denotes a fixing roller; 109A denotes a pressure roller; 110 denotes a paper discharge tray; and 113 denotes a paper transfer roller.

In the color image forming apparatus, the intermediate transfer belt 107 which is flexible against a transfer drum is used; the intermediate transfer belt 107 as an intermediate transfer member is stretched over the roller drive shaft 107A and a pair of driven shaft rollers 107B and conveyed in a circular manner in a clockwise direction; and a belt surface between the pair of driven shaft rollers 107B contacts the photoconductor belt 102 at a circumference of the roller drive shaft 101A from a horizontal direction.

When a normal color image is printed, toner images of respective colors formed on the photoconductor belt 102 are transferred to the intermediate transfer belt 107 every time they are formed, and a color toner image is synthesized. This is transferred at once to a transfer paper conveyed from the paper cassette 106 by the paper transfer roller 113. The transfer paper after transfer is conveyed between the fixing roller 109 and the pressure roller 109A of the fixing apparatus, fixed by the fixing roller 109 and the pressure roller 109A and ejected to the paper discharge tray 110.

When the developing units 105A to 105E develop the toners, the concentration of the toners in the developers contained in the developing units decreases. The decrease of the toner concentration in the developers is detected by a toner concentration sensor. When the decrease of the toner concentration is detected, toner supplying apparatuses connected to the respective developing units are activated to supply toners and increase the toner concentration. Here, the supplied toner may be a developer for a so-called trickle developing system that a carrier and a toner are mixed, provided that the developing units are equipped with a developer discharge mechanism.

In FIG. 3, the toner images are superimposed on the intermediate transfer belt to form an image, but a system where transfer is performed directly from a transfer drum to a recording medium without using an intermediate transfer belt may be considered similarly as an electrophotographic image forming apparatus of the present invention.

Figure 4:
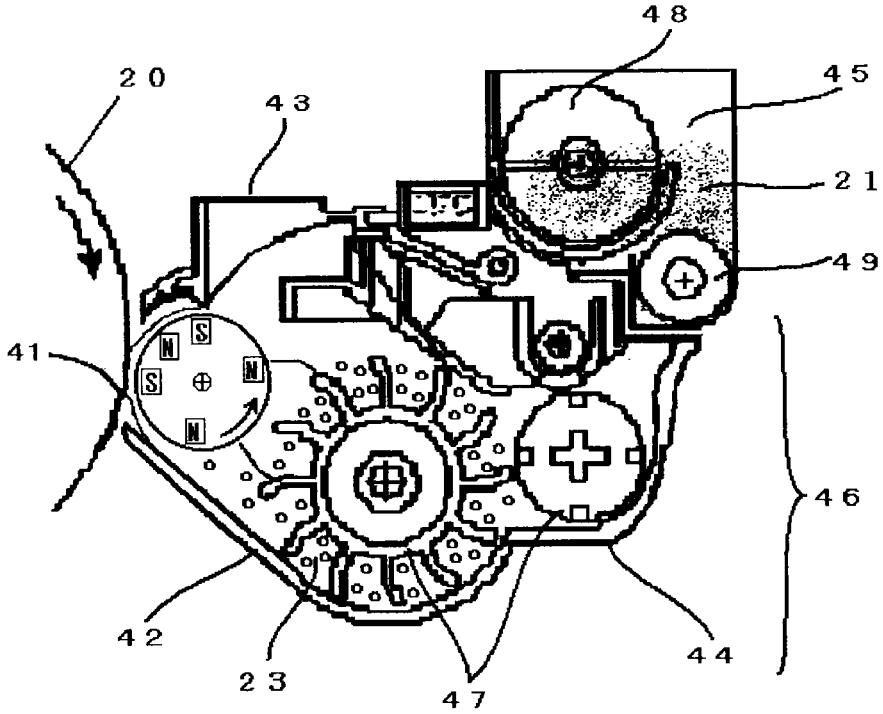
FIG. 4 schematically illustrates one example of a developing device used in the present invention.

FIG. 4 is a diagram illustrating one example of a developing apparatus used in the present invention, and modified examples described hereinafter also belong to the scope of the present invention.

In FIG. 4, a developing apparatus arranged facing a photoconductor 20 as a latent image bearing member is composed primarily of a developing sleeve 41, a developer containing member 42, a developer supply regulating member 43 as a regulating member and a support case 44.

In the support case 44 having an opening on a side of the photoconductor 20, a toner hopper 45 as a toner container which contains a toner 21 is connected internally. A developer container 46 which contains a developer including the toner 21 and a carrier 23 is equipped with a developer stirring mechanism 47 for stirring the toner 21 and the carrier 23 to provide the toner 21 with friction/peeling charge.

The toner hopper 45 is equipped internally with a toner agitator 48 and a toner supplying mechanism 49 as a toner supplying unit turned by a drive unit. The toner agitator 48 and the toner supplying mechanism 49 send the toner 21 in the toner hopper 45 to the developer container 46 with stirring.

The developing sleeve 41 is arranged in a space between the photoconductor 20 and the toner hopper 45. The developing sleeve 41, which is driven to rotate in a direction of an arrow in the figure by a drive unit, includes a magnet as a magnetic field generating unit arranged internally position-invariant relative to the developing apparatus 40 to form a magnetic brush by the carrier 23.

The developer supply regulating member 43 is integrally mounted on a side opposite to the side of the developer containing member 42 attached to the support case 44. In this example, the developer supply regulating member 43 is disposed while maintaining a certain gap between its tip and an outer peripheral surface of the developing sleeve 41.

By employing such an apparatus in an unlimited way, the image forming method of the present invention is accomplished as follows. That is, with the above configuration, the toner 21 sent from an inside of the toner hopper 45 by the toner agitator 48 and the toner supplying mechanism 49 is conveyed to the developer container 46, and the toner is provided with desired friction/peeling charge through stirring by the developer stirring mechanism 47. The toner and the carrier 23 are supported as a developer by the developing sleeve 41 and conveyed to a location opposite to the outer periphery of the photoconductor 20. Only the toner 21 binds electrostatically with the latent electrostatic image formed on the photoconductor 20, and a toner image is formed on the photoconductor 20.

Figure 5:
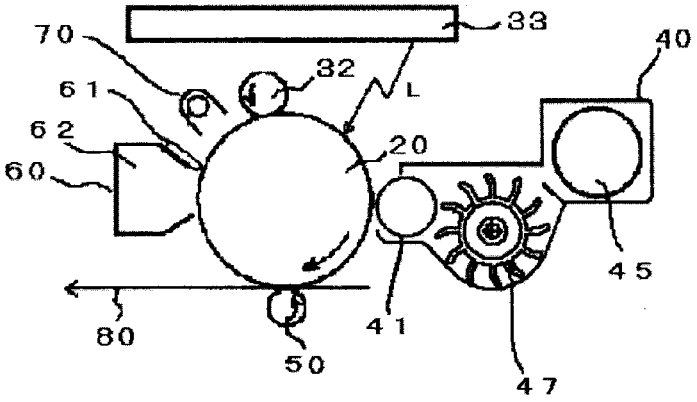
FIG. 5 illustrates one example of an image forming apparatus of the present invention provided with the developing device of FIG. 4.

FIG. 5 is a diagram illustrating one example of an image forming apparatus including the developing apparatus of FIG. 4. A charging member 32, an image exposure system 33, a developing apparatus 40, a transferring apparatus 50, a cleaning apparatus 60 and a discharge lamp 70 are arranged around a drum-shaped photoconductor 20. In this example, a surface of the charging member 32 is not in contact with a surface of the photoconductor, leaving a gap of about 0.2 mm. When the photoconductor 20 is charged by the charging member 32, it is possible and effective to reduce uneven charge by charging the photoconductor 20 with an electric field that an AC component is superimposed on a DC component by a voltage applying unit. The image forming method including a developing method is carried out in the following operations.

A series of processes for forming an image may be described by a negative-positive process. The photoconductor 20 typified by a photoconductor (OPC) having an organic photoconductive layer is discharged by the discharge lamp 70 and uniformly and negatively charged with the charging member 32 such as charger or charging roller, and a latent image is formed thereon by a laser beam irradiated from the image exposure system 33 such as laser optical system (in this example, an absolute value of the potential at an exposed area is lower than an absolute value of the potential at a non-exposed area).

The laser beam L is irradiated from a semiconductor laser and scans a surface of the photoconductor 20 in a direction of the axis of rotation by, for example, a polygonal mirror (polygons) of a polygonal column rotating at a high speed. The latent image formed in this way is developed by a developer composed of a mixture of a toner and a carrier supplied on the developing sleeve 41 as a developer bearing member in the developing apparatus 40, and a toner image is formed. When the latent image is being developed, from a voltage applying mechanism to the developing sleeve 41, a developing bias of a suitable magnitude as a DC voltage or an AC voltage superimposed on the DC voltage is applied between an exposed area and a non-exposed area of the photoconductor 20.

Meanwhile, a recording medium (paper, for example) is fed from a paper feeding mechanism. It is synchronized with a front edge of the image at a pair of upper and lower resist rollers and fed between the photoconductor 20 and the transfer apparatus 50, and the toner image is transferred on the recording medium. Here, a potential of opposite polarity to the polarity of the charged toner is preferably applied as a transfer bias on the transfer apparatus 50. Thereafter, the recording medium 80 is separated from the photoconductor 20, and a transfer image is obtained.

Also, the toner remaining on the photoconductor 20 is recovered by a cleaning blade as a cleaning member in a toner collection chamber 62 in the cleaning apparatus 60.

The recovered toner may be conveyed to the developer container 46 and/or the toner hopper 45 by a toner recycling unit and reused.

The image forming apparatus may be an apparatus equipped with a plurality of the above developing apparatus, where a toner image is sequentially transferred on a transfer medium and sent to a fixing mechanism that fixes the toner by, for example, heat or where a plurality of a toner image is once transferred on an intermediate recording medium, then collectively transferred on a recording medium and fixed in the same manner.

Figure 6:
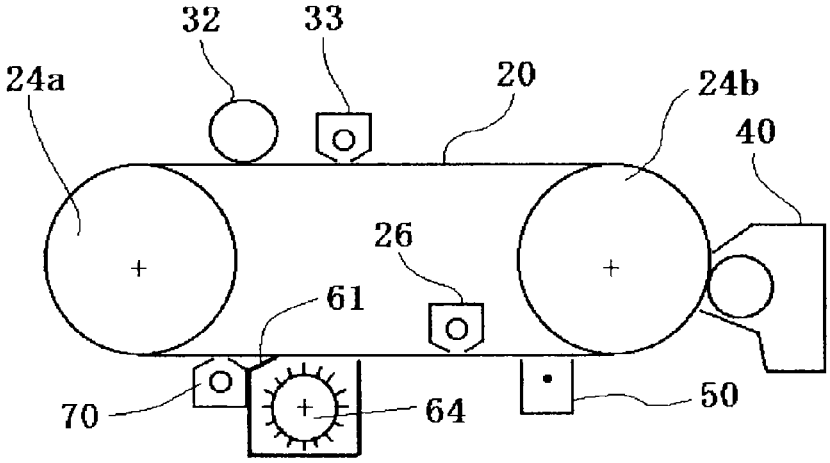
FIG. 6 illustrates another example of an image forming apparatus of the present invention.

FIG. 6 is a diagram illustrating another example of an image forming apparatus used in the present invention. A photoconductor 20 includes at least a photosensitive layer disposed on a conductive substrate, and it is driven by drive rollers 24*a* and 24*b* and is repeatedly subjected to charging by a charging member 32, image exposure by an image exposure system 33, developing by a developing apparatus 40, transfer by a transfer apparatus 50, pre-cleaning exposure by a pre-cleaning exposure light source 26, cleaning by a brush-like cleaning unit 64 and a cleaning blade 61, and discharging by a discharge lamp 70.

In FIG. 6, the photoconductor 20 is subjected to pre-cleaning exposure from a side of the substrate (the substrate is of course transparent in this case).

(Process Cartridge)

A process cartridge of the present invention includes: an electrophotographic photoconductor; and a developing unit configured to develop, with a toner, a latent electrostatic image formed on the electrophotographic photoconductor, to thereby form a visible image; and, if necessary, further includes appropriately selected other units.

The developing unit includes: a developer container which houses the toner; and a developer bearing member for bearing and conveying the developer housed in the developer container; and, if necessary, may further include a layer thickness-regulating member for regulating the layer thickness of a toner borne.

The process cartridge can detachably be mounted to various electrophotographic image forming apparatus. Preferably, it is detachably mounted to the above-described image forming apparatus of the present invention.

Figure 7:
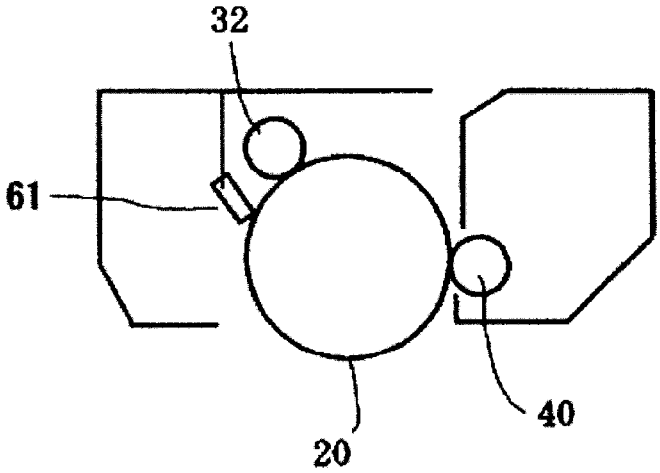
FIG. 7 illustrates one example of a process cartridge of the present invention.

FIG. 7 illustrates one example of the process cartridge of the present invention. This process cartridge uses the toner or developer of the present invention, and includes a photoconductor 20, a proximately-contacted charging member (brush contact charging unit) 32, a developing device 40 which is a developing unit containing the developer of the present invention, and a cleaning unit containing at least a cleaning blade 61, where the member and the units are integrally supported. This is a process cartridge detachably mounted to the main body of an image forming apparatus. In the present invention, the above-described constituent members are integrated as the process cartridge. This process cartridge can be detachably mounted to the main body of the image forming apparatus such as a copier and a printer.

EXAMPLES

The present invention will next be described by way of Examples and Comparative Examples. Note that, the present invention should not be construed as being limited to Examples.

Production Example 1

Synthesis of Crystalline Polyester Resin (A)

Crystalline polyester resins a1 to a6 each were obtained by using a compound as an alcohol component selected from 1,4-butanediol, 1,5-pentanediol and 1,6-hexanediol and a compound as a carboxylic acid component selected from fumaric acid, maleic acid and terephthalic acid.

Specifically, an alcohol component and a carboxylic acid component presented in Table 1 were subjected to esterification reaction under normal pressure at 170° C. to 260° C. in the absence of a catalyst. Then, antimony trioxide was added to the reaction system at a concentration of 400 ppm with respect to the total carboxylic acid components and subjected to condensation polymerization at 250° C. under a vacuum of 3 Torr with glycol being removed out of the system, to thereby obtain a crystalline resin. Here, the reaction was performed until the stirring torque reached 10 kg·cm (100 ppm), and the reaction was terminated by releasing the vacuum condition of the reaction system.

Figure 2:
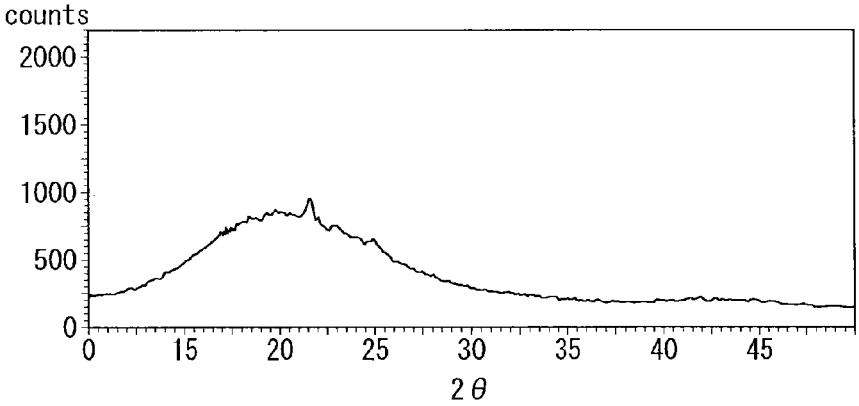
FIG. 2 is an X-ray diffraction chart of a toner used in Example 1-24.

It was confirmed that the obtained crystalline polyester resins a1 to a6 were crystalline polyesters since they had at least one diffraction peak existing at a location of $2\theta=19°$ to 25° in an X-ray diffraction pattern obtained by a powder X-ray diffraction apparatus (product of Rigaku Corporation, Ltd., RINT 1100). Specifically, the at least one diffraction peak was detected by searching peaks in the X-ray diffraction pattern obtained and processed under the following conditions: vacuum tube: Cu; tube voltage-current: 50 kV-30 mA, goniometer: a wide-angle goniometer; sampling range: 0.020°; scanning speed: 2.0°/min; scanning range: 5° to 50°; and diffraction peaks: smoothing number 11. FIG. 1 is an X-ray diffraction chart of the crystalline polyester resin a6.

The glass transition temperature Tga of each of the crystalline polyester resins a1 to a6 was measured by raising the temperature of the crystalline polyester resin at 10° C./min from 20° C. to 150° C. using a differential scanning calorimeter (DSC-60, product of Shimadzu Corporation, Ltd.).

The softening temperature (T1/2a) of each of the crystalline polyester resins a1 to a6 was measured using an elevated flow tester CFT-500 (product of Shimadzu Corporation, Ltd.) by melting and flowing a sample of 1 $cm^3$ under the conditions: the diameter of a die hole: 1 mm, the pressure applied: 20 $kg/cm^2$ and the temperature raising rate: 6° C./min. The softening temperature (T1/2a) thereof was defined as a temperature corresponding to ½ the range between a flow start point and a flow end point.

The presence of the ester bond represented by the following General Formula (1) in a main chain of each of the crystalline polyester resins a1 to a6 was identified by solid $C^{13}$NMR. The results are presented in Table 1.

$$—[OCO—R—COO—(CH_2)_n] \qquad \text{General Formula (1)}$$

In General Formula (1), R represents a C2-C20 linear, unsaturated, aliphatic, divalent carboxylic acid residue, and n is an integer of 2 to 20.

Non-crystalline resins b1-4 and b2-2 used were styrene-acrylic resins (styrene/methyl acrylate copolymer resins).

The obtained non-crystalline resins b1-1 to b1-4 and b2-1 to b2-3 were confirmed as non-crystalline since no diffraction peaks existed in their respective x-ray diffraction patterns measured in the same manner as in Production Example 1.

In addition, the non-crystalline resins b1-1 to b1-4 and b2-1 to b2-3 were measured for glass transition temperature Tgb and softening temperature T1/2b in the same manner as in Production Example 1. The results are presented in Tables 2-1 and 2-2.

The amount of the chloroform insoluble matter in each of the non-crystalline resins b1-1 to b1-4 was measured as follows. Specifically, 1.0 g of the toner was weighed, and 50 g of chloroform was added to the toner, followed by thoroughly dissolving. The resultant solution was subjected to centrifugal separation, and the resultant product was filtrated at normal temperature using a qualitative filter paper of class 5C of JIS (P3801). The residue on the filter paper was the insoluble matter. The amount of the chloroform insoluble matter was expressed as a ratio (% by mass) of the mass of the residue on the filter paper to the mass of the toner used. The results are presented in Table 2-1.

Each of the obtained non-crystalline resins b2-1 to b2-3 was measured for a main peak and a half width through GPC (gel permeation chromatography) in the following manner. The results are presented in Table 2-2.

Specifically, a column was conditioned in a heat chamber of 40° C., and then THF as a solvent was caused to pass through the column of the same temperature at a flow rate of 1 mL/min. Subsequently, a separately prepared THF solution of the resin (concentration: 0.05% by mass to 0.6% by mass) was applied to the column in an amount of 50 μL to 200 μL.

In the measurement of the molecular weight of the resin sample, the molecular weight distribution of the resin sample was determined based on the relationship between the logarithmic value and the count number of a calibration curve given by using several monodispersed polystyrene-standard samples.

The monodispersed polystyrene-standard samples used for giving the calibration curve were those available from Pressure Chemical Co. or Tosoh Co. each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. At least about 10 monodispersed polystyrene-standard samples were used. The detector used was a refractive index (RI) detector.

TABLE 1

| Crystalline polyester resin (A) | Glass transition temperature Tga (° C.) | Softening temperature T1/2a (° C.) | Presence or absence of ester bond represented by General Formula (1) | Alcohol component | Carboxylic acid component |
|---|---|---|---|---|---|
| a1 | 98 | 104 | Absence | 1,5-Pentanediol | Fumaric acid |
| a2 | 81 | 86 | Absence | 1,4-Butanediol | Terephthalic acid |
| a3 | 84 | 89 | Absence | 1,5-Pentanediol | Maleic acid |
| a4 | 116 | 122 | Absence | 1,6-Hexanediol | Terephthalic acid |
| a5 | 119 | 126 | Absence | 1,5-Pentanediol | Terephthalic acid |
| a6 | 100 | 106 | Presence | 1,6-Hexanediol | Fumaric acid |

Production Example 2

Synthesis of Non-Crystalline Resin (B)

Non-crystalline resins b1-1 to b1-3 and b2-1 and b2-3 were obtained as follows.

Monomers presented in Tables 2-1 and 2-2 were subjected to esterification reaction under normal pressure at 170° C. to 260° C. in the absence of a catalyst. Then, antimony trioxide was added to the reaction system at a concentration of 400 ppm with respect to the total carboxylic acid components and subjected to condensation polymerization at 250° C. under a vacuum of 3 Torr (399.966 Pa) with glycol being removed out of the system, to thereby obtain a resin. Here, the crosslinking reaction was performed until the stirring torque reached 10 kg·cm (100 ppm), and the reaction was terminated by releasing the vacuum condition of the reaction system.

TABLE 2-1

| Non-crystalline resin (B) | Material | Glass transition temperature Tgb [° C.] | Softening temperature T1/2b [° C.] | Chloroform insoluble matter [% by mass] | Acid component | Alcohol component |
|---|---|---|---|---|---|---|
| b1-1 | Polyester | 60 | 140 | 21 | Fumaric acid Trimellitic anhydride | Bisphenol A (2,2)propylene oxide Bisphenol A (2,2)ethylene oxide |
| b1-2 | Polyester | 61 | 145 | 4 | Isophthalic acid Trimellitic anhydride | Bisphenol A (2,2)propylene oxide Bisphenol A (2,2)ethylene oxide |
| b1-3 | Polyester | 59 | 141 | 41 | Fumaric acid Trimellitic anhydride | Ethylene glycol Bisphenol A (2,2)propylene oxide Bisphenol A (2,2)ethylene oxide |
| b1-4 | Styrene acryl | 60 | 165 | 13 | | — |

TABLE 2-2

| Non-crystalline resin (B) | Material | Glass transition temperature Tgb [° C.] | Softening temperature T1/2b [° C.] | Molecular weight distribution Main peak | Molecular weight distribution Half width | Acid component | Alcohol component |
|---|---|---|---|---|---|---|---|
| b2-1 | Polyester | 63 | 100 | 5,000 | 17,000 | Fumaric acid | Bisphenol A (2,2)propylene oxide Bisphenol A (2,2)ethylene oxide |
| b2-2 | Styrene acryl | 60 | 135 | 14,000 | 31,000 | | — |
| b2-3 | Polyester | 62 | 89 | 4,000 | 13,000 | Terephthalic acid Dodecenyl succinic anhydride Trimellitic anhydride | Bisphenol A (2,2)propylene oxide Bisphenol A (2,2)ethylene oxide |

Production Example 3

Synthesis of Composite Resin c1

In a 5-L, four-necked flask equipped with a nitrogen inlet tube, a dehydration tube, a stirrer, a dropping funnel and a thermocouple, 0.8 mol of terephthalic acid, 0.6 mol of fumaric acid, 0.8 mol of trimellitic anhydride, 1.1 mol of bisphenol A (2,2)propylene oxide and 0.5 mol of bisphenol A (2,2)ethylene oxide as condensation polymerization monomers, and 0.5 mol of dibutyl tin oxide as an esterification catalyst were placed. It was heated to 135° C. in a nitrogen atmosphere.

Then, 10.5 mol of styrene, 3 mol of acrylic acid and 1.5 mol of 2-ethyl hexylacrylate as addition polymerization monomers and 0.24 mol of t-butyl hydroperoxide as a polymerization initiator were placed in the dropping funnel, whereby a mixture was obtained.

The resultant mixture was added dropwise to the four-necked flask for 5 hours, and the reaction was performed for 6 hours under stirring.

Then, the temperature was raised to 210° C. for 3 hours, and a reaction was performed at 210° C. and 10 kPa until a desired softening temperature, whereby composite resin c1 was synthesized.

Through the above reaction, the condensation polymerization monomers, the addition polymerization monomers and acrylic acid serving as the condensation-addition polymerization-reactive monomer were allowed to react together, to thereby form a hybrid resin where the condensation polymerization resin unit and the addition polymerization resin unit were chemically bonded together. The addition polymerization reaction was promoted at 135° C., and the condensation polymerization reaction was promoted by raising the temperature to 210° C.

The obtained composite resin c1 was found to have a softening temperature (T1/2c) of 115° C., a glass transition temperature (Tgc) of 58° C., and an acid value of 25 mgKOH/g.

The acid value of the composite resin c1 was measured according to JIS K-0070 in the following manner.

First, 0.5 g to 2.0 g of a sample produced by pulverizing the obtained resin was precisely weighed and measured for mass (W g). Next, the sample was placed in a 300-mL beaker and dissolved using 150 mL of a liquid mixture of toluene/ethanol (4/1 by volume). The resultant sample solution and a blank sample were titrated with a 0.1 mol/L solution of KOH in ethanol using a potentiometric titrator. Using the amount (S mL) of the KOH solution consumed for the sample solution and the amount (B mL) of the KOH solution consumed for the blank sample, the acid value of the sample was calculated based on the following equation (1):

$$\text{Acid value(mgKOH/g)}=\{(S-B)\times f\times 5.61\}/W \qquad \text{Equation (1)}$$

where f is a factor of KOH.

Production Example 4

Synthesis of Composite Resin c2

Composite resin c2 was synthesized in the same manner as Production Example 3 except that hexamethylene diamine and ϵ-caprolactam as condensation polymerization monomers and styrene, acrylic acid and 2-ethylhexyl acrylate as addition polymerization monomers were used.

The obtained composite resin c2 was found to have a softening temperature (T1/2c) of 113° C., a glass transition temperature (Tgc) of 65° C., and an acid value of 10 mgKOH/g.

<Other Toner Materials>

The following Table 3 presents the other toner materials than the crystalline polyester resin (A), the non-crystalline resin (B) and the composite resin (C) used in Examples and Comparative Examples.

TABLE 3

| | Symbol | Name | Manufacturer | Remarks |
|---|---|---|---|---|
| Colorant | p1 | Carbon black | Mitsubishi Chemical Co. Ltd. | |
| | p2 | Phthalocyanine blue | TOYOCOLOR CO., LTD. | |
| Releasing agent | w1 | Carnauba wax | CERARICA NODA Co., Ltd. | m.p.: 81° C. |
| | w2 | Polyethylene wax | Mitsui Chemicals Co., Ltd. | |
| Charge-controlling agent | t1 | Monoazo metal complex (BONTRON S-34) | Orient Chemical Industries, Ltd. | Chrome-based complex salt dye |
| | t2 | Salicylic acid metal compound (BONTRON E-84) | Orient Chemical Industries, Ltd. | |
| Fatty acid amide compound | s1 | N,N'-ethylene-bisstearic acid amide | Kao Co., Ltd. | |

Example 1-1

Production of Toner

The raw materials presented in Tables 1 to 3 were premixed in accordance with the formulations presented in the following Tables 4-1-1 and 4-1-2 using HENSCHEL MIXER (product of Mitsui Miike Machinery Co., Ltd., FM20B) and then melt-kneaded at a temperature of 100° C. to 130° C. using a biaxial kneader (PCM-30, product of IKEGAI LTD.). The resultant kneaded product was rolled to an average thickness of 2.8 mm, then cooled to room temperature by a belt cooler and finally coarsely pulverized to 200 μm to 300 μm using a hammer mill. It was then finely pulverized using a supersonic jet mill LABOJET (product of Nippon Pneumatic Mfg. Co., Ltd.) and classified using a dispersion separator (MDS-I, product of Nippon Pneumatic Mfg. Co., Ltd.) while appropriately adjusting the opening of louvers so that the mass average particle diameter of the classified product was 5.6 μm±0.2 μm, whereby toner base particles were obtained. Then, 1.0 part by mass of hydrophobic silica particles (HDK-2000, product of Clariant K.K.) and 100 parts by mass of the toner base particles were stirred and mixed together using HENSCHEL MIXER to produce toner 1-1.

A molecular weight distribution of the produced toner 1-1 was measured in the same manner as in Production Example 2, and a main peak of the molecular weight and a half width of the molecular weight distribution were determined. The results are presented in Table 4-2.

In addition, using a differential scanning calorimeter (DSC-60, product of Shimadzu Corporation, Ltd.), the DSC peak temperature and the endothermic amount in a range of 90° C. to 130° C. attributed to the crystalline polyester resin (A) of the toner 1-1 were determined from a DSC chart obtained when the toner 1-1 was raised in temperature from at 10° C./min from 20° C. to 150° C. The results are presented in Table 4-2.

Furthermore, the amount of the chloroform insoluble matter in the toner was confirmed in the same manner as in Production Example 2. The results are presented in Table 4-2.

<Production of Developer>

Next, 5% by mass of the produced toner 1-1 and 95% by mass of a coating ferrite carrier were uniformly mixed using a TURBULA mixer (product of Willy A. Bachofen AG Maschinenfabrik) at 48 rpm for 5 min, to thereby produce developer 1-1.

<Low-Temperature Fixing Property, Hot Offset Resistance and Thin-Line Reproducibility (Initial)>

Using the aforementioned image forming apparatus (product of Ricoh Company, Ltd.), an image was printed using the developer 1-1. Note that, the developer 1-1 was housed in the development unit 105D of the image forming apparatus schematically illustrated in FIG. 3 (i.e., the development units 105A to C were not used).

A solid image with a deposited amount of 0.4 mg/cm$^2$ was printed on paper (TYPE6200, product of Ricoh Company, Ltd.) through exposing, developing and transfer steps. A linear velocity of fixing was set to 160 mm/sec. Images were printed with a fixing temperature increasing in increment of 5° C., and a lower-limit temperature (lower-limit fixing temperature: low-temperature fixing property) where no cold offset occurs and an upper-limit temperature (upper-limit fixing temperature: hot offset resistance) where no hot offset occurs were measured. An NIP width of the fixing device was 11 mm. Also, a character chart having an image area ratio of 5% (a character has a size of about 2 mm×about 2 mm) was printed out separately with the toner at a fixing temperature of the lower-limit fixing temperature+20° C., and thin-line reproducibility (initial) was visually evaluated. The results are presented in Table 5. Note that, the evaluation criteria for the evaluations are as follows.

<<Evaluation Criteria of Low-Temperature Fixing Property>>

A: less than 130° C.
B: 130° C. or greater but less than 140° C.
C: 140° C. or greater but less than 150° C.
D: 150° C. or greater but less than 160° C.
E: 160° C. or greater <<Evaluation Criteria of Hot-Offset Resistance>>

A: 200° C. or greater
B: 190° C. or greater but less than 200° C.
C: 180° C. or greater but less than 190° C.
D: 170° C. or greater but less than 180° C.
E: less than 170° C.

<<Evaluation Criteria of Thin-Line Reproducibility (Initial)>>

A: particularly favorable
B: favorable
C: generally acceptable
D: no practical problem
E: not acceptable <Thin-Line Reproducibility (Over Time)>

After evaluation of the initial thin-line reproducibility, a character chart having an image area ratio of 5% (a character has a size of about 2 mm×about 2 mm) was continuously printed out on 100,000 sheets at a fixing temperature of the lower-limit fixing temperature+20° C. while the toner was supplied, and its thin-line reproducibility over time was visually evaluated. The same evaluation criteria as the initial thin-line reproducibility were used. The results are presented in Table 5.

<Smear Resistance>

At the lower-limit fixing temperature, a half-tone image having an image area ratio of 60% and a toner deposited amount of 0.40 mg/cm$^2$±0.1 mg/cm$^2$ was printed out on paper (TYPE6200, product of Ricoh Company, Ltd.). The fixed image portion was rubbed 10 times with a white cotton cloth (No. 3 cotton JIS L0803) using a clock meter (product of SDL ATLUS), and an ID of the smear on the cloth (hereinafter referred to as smear ID) was measured. The smear ID was measured using a colorimeter (X-RITE 938, product of X-Rite, Co.). Here, the color in the measurement was black. The results are presented in Table 5.

<<Evaluation Criteria of Smear Resistance>>

A: Smear ID was 0.20 or less
B: Smear ID was greater than 0.20 but 0.35 or less
D: Smear ID was greater than 0.35 but 0.55 or less
E: Smear ID was greater than 0.55

<Heat Resistance Storageability>

In a 30-mL screw-top vial, 10 g of the toner was placed. The vial was tapped 100 times with a tapping machine and then stored in a thermostat at 50° C. for 24 hours. The vial was returned to room temperature, and the toner was measured for its penetration using a penetration testing machine as an evaluation of heat resistance storageability. The results are presented in Table 5.

<<Evaluation Criteria of Heat Resistance Storageability>>

A: complete penetration
B: 20 mm or greater
C: 15 mm or greater but less than 20 mm
D: 10 mm or greater but less than 15 mm
E: less than 10 mm

Examples 1-2 to 1-24 and Comparative Examples 1-1 to 1-9

Toners 1-2 to 1-33 and developers containing them were produced by performing the mixing, kneading, pulverizing, and mixing with additives in the same manner as in Example 1-1 except that the amounts of the toner raw materials were changed as described in Tables 4-1-1 and 4-1-2. In some Examples, the average thickness of the kneaded product rolled was changed as described in Table 4-2, and a fatty acid amide compound was added in an amount described in Tables 4-1-1 and 4-1-2. These toners and developers were evaluated in terms of the above evaluation items in the same manner as in Example 1-1.

In Example 1-17 (toner 1-26), since dispersibility of colorant p2 was poor in the binder resin, the colorant p2 was pre-kneaded, before mixed with the other raw materials, with non-crystalline resin b2-3 and pure water according to the following formulation, to thereby form a masterbatch containing the colorant p2 from which the toner was produced. The formation into the toner was performed so that the final amounts of the raw materials were adjusted to those described in Tables 4-1-1 and 4-1-2 on the basis of the amount of the non-crystalline resin b2-3 contained in the masterbatch. In Example 1-17, smear resistance was evaluated using cyan.

Formulation of the Masterbatch of Example 1-17

Toner 1-26

| | |
|---|---|
| Non-crystalline resin: b2-3 | 100 parts by mass |
| Colorant: p2 | 50 parts by mass |
| Pure water | 50 parts by mass |

In the present invention, a method usable for producing a masterbatch should not be construed as being limited to the above method.

TABLE 4-1-1

| | | Crystalline polyester resin (A) | | Non-crystalline resin (B1) | | Non-crystalline resin (B2) | | Composite resin (C) | | Colorant | | Releasing agent | | Charge-controlling agent | | Fatty acid amide compound | |
|---|---|---|---|---|---|---|---|---|---|---|---|---|---|---|---|---|---|
| | Toner | Type | Parts* | Type | Parts | Type | Parts | Type | Parts | Type | Parts | Type | Parts | Type | Parts | Type | Parts |
| Ex. 1-1 | Toner 1-1 | a1 | 4 | b1-1 | 35 | b2-1 | 55 | c1 | 10 | p1 | 14 | w1 | 6 | t1 | 2 | Not used | |
| Comp. Ex. 1-1 | Toner 1-2 | Not used | | b1-1 | 35 | b2-1 | 55 | c1 | 10 | p1 | 14 | w1 | 6 | t1 | 2 | Not used | |
| Comp. Ex. 1-2 | Toner 1-3 | a1 | 4 | Not used | | b2-1 | 90 | c1 | 10 | p1 | 14 | w1 | 6 | t1 | 2 | Not used | |
| Comp. Ex. 1-3 | Toner 1-4 | a1 | 4 | b1-1 | 35 | b2-1 | 55 | Not used | | p1 | 14 | w1 | 6 | t1 | 2 | Not used | |
| Comp. Ex. 1-4 | Toner 1-5 | a1 | 4 | b1-1 | 20 | b2-1 | 70 | c1 | 10 | p1 | 14 | w1 | 6 | t1 | 2 | Not used | |
| Ex. 1-2 | Toner 1-6 | a1 | 4 | b1-1 | 25 | b2-1 | 65 | c1 | 10 | p1 | 14 | w1 | 6 | t1 | 2 | Not used | |
| Ex. 1-3 | Toner 1-7 | a1 | 4 | b1-1 | 40 | b2-1 | 50 | c1 | 10 | p1 | 14 | w1 | 6 | t1 | 2 | Not used | |
| Comp. Ex. 1-5 | Toner 1-8 | a1 | 4 | b1-1 | 45 | b2-1 | 45 | c1 | 10 | p1 | 14 | w1 | 6 | t1 | 2 | Not used | |

TABLE 4-1-1-continued

| | | Crystalline polyester resin (A) | | Non-crystalline resin (B1) | | Non-crystalline resin (B2) | | Composite resin (C) | | Colorant | | Releasing agent | | Charge-controlling agent | | Fatty acid amide compound | |
|---|---|---|---|---|---|---|---|---|---|---|---|---|---|---|---|---|---|
| | Toner | Type | Parts* | Type | Parts | Type | Parts | Type | Parts | Type | Parts | Type | Parts | Type | Parts | Type | Parts |
| Ex. 1-4 | Toner 1-9 | a1 | 4 | b1-1 | 28 | b2-1 | 62 | c1 | 5 | p1 | 14 | w1 | 6 | t1 | 2 | Not used | |
| Comp. Ex. 1-6 | Toner 1-10 | a1 | 4 | b1-1 | 30 | b2-1 | 60 | c1 | 5 | p1 | 14 | w1 | 6 | t1 | 2 | Not used | |
| Comp. Ex. 1-7 | Toner 1-11 | a2 | 4 | b1-1 | 35 | b2-1 | 55 | c1 | 10 | p1 | 14 | w1 | 6 | t1 | 2 | Not used | |
| Ex. 1-5 | Toner 1-12 | a3 | 4 | b1-1 | 35 | b2-1 | 55 | c1 | 10 | p1 | 14 | w1 | 6 | t1 | 2 | Not used | |
| Ex. 1-6 | Toner 1-13 | a4 | 4 | b1-1 | 35 | b2-1 | 55 | c1 | 10 | p1 | 14 | w1 | 6 | t1 | 2 | Not used | |
| Comp. Ex. 1-8 | Toner 1-14 | a5 | 4 | b1-1 | 35 | b2-1 | 55 | c1 | 10 | p1 | 14 | w1 | 6 | t1 | 2 | Not used | |
| Ex. 1-7 | Toner 1-15 | a1 | 1 | b1-1 | 35 | b2-1 | 55 | c1 | 10 | p1 | 14 | w1 | 6 | t1 | 2 | Not used | |
| Ex. 1-8 | Toner 1-16 | a1 | 2 | b1-1 | 35 | b2-1 | 55 | c1 | 10 | p1 | 14 | w1 | 6 | t1 | 2 | Not used | |
| Ex. 1-9 | Toner 1-17 | a1 | 16 | b1-1 | 35 | b2-1 | 55 | c1 | 10 | p1 | 14 | w1 | 6 | t1 | 2 | Not used | |
| Ex. 1-10 | Toner 1-18 | a1 | 19 | b1-1 | 35 | b2-1 | 55 | c1 | 10 | p1 | 14 | w1 | 6 | t1 | 2 | Not used | |

In Table 4-1-1, the unit "parts" means "parts by mass."

TABLE 4-1-2

| | | Crystalline polyester resin (A) | | Non-crystalline resin (B1) | | Non-crystalline resin (B2) | | Composite resin (C) | | Colorant | | Releasing agent | | Charge-controlling agent | | Fatty acid amide compound | |
|---|---|---|---|---|---|---|---|---|---|---|---|---|---|---|---|---|---|
| | Toner | Type | Parts* | Type | Parts | Type | Parts | Type | Parts | Type | Parts | Type | Parts | Type | Parts | Type | Parts |
| Ex. 1-11 | Toner 1-19 | a1 | 4 | b1-1 | 35 | b2-3 | 55 | c1 | 10 | p1 | 14 | w1 | 6 | t1 | 2 | Not used | |
| Ex. 1-12 | Toner 1-20 | a1 | 4 | b1-1 | 35 | b2-3 | 55 | c1 | 10 | p1 | 14 | w1 | 6 | t1 | 2 | s1 | 2 |
| Ex. 1-13 | Toner 1-21 | a1 | 4 | b1-2 | 35 | b2-3 | 55 | c1 | 10 | p1 | 14 | w1 | 6 | t1 | 2 | s1 | 2 |
| Ex. 1-14 | Toner 1-22 | a1 | 4 | b1-2 | 60 | b2-3 | 30 | c1 | 10 | p1 | 14 | w1 | 6 | t1 | 2 | s1 | 2 |
| Ex. 1-15 | Toner 1-23 | a1 | 4 | b1-3 | 15 | b2-3 | 75 | c1 | 10 | p1 | 14 | w1 | 6 | t1 | 2 | s1 | 2 |
| Ex. 1-16 | Toner 1-24 | a1 | 4 | b1-3 | 75 | b2-3 | 15 | c1 | 10 | p1 | 14 | w1 | 6 | t1 | 2 | s1 | 2 |
| Comp. Ex. 1-9 | Toner 1-25 | a1 | 4 | b1-3 | 80 | b2-3 | 10 | c1 | 10 | p1 | 14 | w1 | 6 | t1 | 2 | s1 | 2 |
| Ex. 1-17 | Toner 1-26 | a1 | 4 | b1-1 | 35 | b2-3 | 55 | c1 | 10 | p2 | 14 | w1 | 6 | t1 | 2 | s1 | 2 |
| Ex. 1-18 | Toner 1-27 | a1 | 4 | b1-4 | 35 | b2-2 | 55 | c1 | 10 | p1 | 14 | w1 | 6 | t1 | 2 | s1 | 2 |
| Ex. 1-19 | Toner 1-28 | a1 | 4 | b1-1 | 35 | b2-3 | 55 | c1 | 10 | p1 | 14 | w2 | 6 | t1 | 2 | s1 | 2 |
| Ex. 1-20 | Toner 1-29 | a6 | 1 | b1-1 | 35 | b2-3 | 55 | c1 | 10 | p1 | 14 | w1 | 6 | t1 | 2 | s1 | 2 |
| Ex. 1-21 | Toner 1-30 | a6 | 4 | b1-1 | 35 | b2-3 | 55 | c2 | 10 | p1 | 14 | w1 | 6 | t1 | 2 | s1 | 2 |
| Ex. 1-22 | Toner 1-31 | a1 | 1 | b1-1 | 35 | b2-3 | 55 | c1 | 10 | p1 | 14 | w1 | 6 | t1 | 2 | s1 | 2 |
| Ex. 1-23 | Toner 1-32 | a6 | 4 | b1-1 | 35 | b2-3 | 55 | c1 | 10 | p1 | 14 | w1 | 6 | t2 | 2 | s1 | 2 |
| Ex. 1-24 | Toner 1-33 | a6 | 4 | b1-1 | 35 | b2-3 | 55 | c1 | 10 | p1 | 14 | w1 | 6 | t2 | 2 | s1 | 2 |

In Table 4-1-2, the unit "parts" means "parts by mass."

TABLE 4-2

| | | Avg. thickness of the product | Molecular weight of toner | | DSC peak | Endothermic amount of | Chloroform insoluble |
|---|---|---|---|---|---|---|---|
| | Toner | rolled mm | Main peak | Half width | temp. ° C. | DSC peak J/g | matter % by mass |
| Ex. 1-1 | Toner 1-1 | 2.8 | 7400 | 13000 | 108 | 5 | 7 |
| Comp. Ex. 1-1 | Toner 1-2 | 2.8 | 7400 | 13000 | — | — | 7 |
| Comp. Ex. 1-2 | Toner 1-3 | 2.8 | 7400 | 13000 | 108 | 5 | 0 |
| Comp. Ex. 1-3 | Toner 1-4 | 2.8 | 7400 | 13000 | 108 | 5 | 6 |
| Comp. Ex. 1-4 | Toner 1-5 | 2.8 | 900 | 9000 | 108 | 5 | 3 |
| Ex. 1-2 | Toner 1-6 | 2.8 | 1100 | 10000 | 108 | 5 | 4 |
| Ex. 1-3 | Toner 1-7 | 2.8 | 9800 | 13800 | 108 | 5 | 8 |
| Comp. Ex. 1-5 | Toner 1-8 | 2.8 | 11000 | 14100 | 108 | 5 | 8 |
| Ex. 1-4 | Toner 1-9 | 2.8 | 8800 | 14500 | 108 | 5 | 4 |
| Comp. Ex. 1-6 | Toner 1-10 | 2.8 | 9000 | 16000 | 108 | 5 | 6 |
| Comp. Ex. 1-7 | Toner 1-11 | 2.8 | 7400 | 13000 | 88 | 5 | 7 |
| Ex. 1-5 | Toner 1-12 | 2.8 | 7400 | 13000 | 92 | 5 | 7 |
| Ex. 1-6 | Toner 1-13 | 2.8 | 7400 | 13000 | 127 | 5 | 7 |
| Comp. Ex. 1-8 | Toner 1-14 | 2.8 | 7400 | 13000 | 131 | 5 | 7 |
| Ex. 1-7 | Toner 1-15 | 2.8 | 7400 | 13000 | 108 | 0.5 | 7 |
| Ex. 1-8 | Toner 1-16 | 2.8 | 7400 | 13000 | 108 | 2 | 7 |
| Ex. 1-9 | Toner 1-17 | 2.8 | 7400 | 13000 | 108 | 14 | 7 |
| Ex. 1-10 | Toner 1-18 | 2.8 | 7400 | 13000 | 108 | 16 | 7 |
| Ex. 1-11 | Toner 1-19 | 2.8 | 7000 | 13000 | 108 | 5 | 7 |
| Ex. 1-12 | Toner 1-20 | 2.8 | 6500 | 13000 | 108 | 5 | 7 |
| Ex. 1-13 | Toner 1-21 | 2.8 | 3500 | 8500 | 108 | 5 | 1 |
| Ex. 1-14 | Toner 1-22 | 2.8 | 8000 | 9000 | 108 | 5 | 2 |

TABLE 4-2-continued

| | Toner | Avg. thickness of the product rolled mm | Molecular weight of toner Main peak | Molecular weight of toner Half width | DSC peak temp. ° C. | Endothermic amount of DSC peak J/g | Chloroform insoluble matter % by mass |
|---|---|---|---|---|---|---|---|
| Ex. 1-15 | Toner 1-23 | 2.8 | 9300 | 12800 | 108 | 5 | 20 |
| Ex. 1-16 | Toner 1-24 | 2.8 | 9500 | 13000 | 108 | 5 | 29 |
| Comp. Ex. 1-9 | Toner 1-25 | 2.8 | 9500 | 14000 | 108 | 5 | 31 |
| Ex. 1-17 | Toner 1-26 | 2.8 | 7000 | 12500 | 108 | 5 | 7 |
| Ex. 1-18 | Toner 1-27 | 2.8 | 9000 | 13500 | 108 | 5 | 4 |
| Ex. 1-19 | Toner 1-28 | 2.8 | 6900 | 12500 | 108 | 5 | 6 |
| Ex. 1-20 | Toner 1-29 | 2.8 | 7200 | 12500 | 110 | 5 | 7 |
| Ex. 1-21 | Toner 1-30 | 2.8 | 7000 | 12500 | 110 | 5 | 7 |
| Ex. 1-22 | Toner 1-31 | 2.6 | 6000 | 12500 | 108 | 2 | 7 |
| Ex. 1-23 | Toner 1-32 | 2.2 | 7000 | 12500 | 110 | 3 | 7 |
| Ex. 1-24 | Toner 1-33 | 2.8 | 7000 | 12500 | 110 | 5 | 7 |

TABLE 5

| | Toner | Low-temp. fixing property | Hot offset resistance | Heat resistance storage-ability | Thin-line reproducibility (initial) | Thin-line reproducibility (over time) | Smear resistance |
|---|---|---|---|---|---|---|---|
| Ex. 1-1 | Toner 1-1 | B | B | B | A | A | B |
| Comp. Ex. 1-1 | Toner 1-2 | E | B | D | A | A | B |
| Comp. Ex. 1-2 | Toner 1-3 | A | E | E | A | B | B |
| Comp. Ex. 1-3 | Toner 1-4 | B | B | E | B | D | B |
| Comp. Ex. 1-4 | Toner 1-5 | B | E | E | A | B | B |
| Ex. 1-2 | Toner 1-6 | B | D | C | A | B | B |
| Ex. 1-3 | Toner 1-7 | D | B | B | A | A | B |
| Comp. Ex. 1-5 | Toner 1-8 | E | B | B | A | A | B |
| Ex. 1-4 | Toner 1-9 | D | B | B | A | A | B |
| Comp. Ex. 1-6 | Toner 1-10 | E | B | B | A | A | B |
| Comp. Ex. 1-7 | Toner 1-11 | B | D | E | A | A | B |
| Ex. 1-5 | Toner 1-12 | B | C | C | A | A | B |
| Ex. 1-6 | Toner 1-13 | C | B | B | A | A | B |
| Comp. Ex. 1-8 | Toner 1-14 | E | B | B | A | A | B |
| Ex. 1-7 | Toner 1-15 | B | B | D | A | A | B |
| Ex. 1-8 | Toner 1-16 | B | B | C | A | A | B |
| Ex. 1-9 | Toner 1-17 | A | B | C | A | A | B |
| Ex. 1-10 | Toner 1-18 | A | B | D | A | A | B |
| Ex. 1-11 | Toner 1-19 | B | B | C | A | A | B |
| Ex. 1-12 | Toner 1-20 | A | B | B | A | A | A |
| Ex. 1-13 | Toner 1-21 | A | D | D | A | B | A |
| Ex. 1-14 | Toner 1-22 | A | C | D | A | B | A |
| Ex. 1-15 | Toner 1-23 | C | A | A | A | A | A |
| Ex. 1-16 | Toner 1-24 | D | A | A | A | A | A |
| Comp. Ex. 1-9 | Toner 1-25 | E | A | A | A | A | A |
| Ex. 1-17 | Toner 1-26 | A | C | B | A | A | A |
| Ex. 1-18 | Toner 1-27 | C | C | A | A | A | A |
| Ex. 1-19 | Toner 1-28 | A | C | B | A | A | B |
| Ex. 1-20 | Toner 1-29 | A | B | A | A | A | A |
| Ex. 1-21 | Toner 1-30 | A | B | C | C | D | A |
| Ex. 1-22 | Toner 1-31 | C | B | D | B | B | A |
| Ex. 1-23 | Toner 1-32 | A | A | B | A | A | A |
| Ex. 1-24 | Toner 1-33 | A | A | A | A | A | A |

Production Example 5

Production Example of an Intermediate Transfer Member

Pyromellitic anhydride and 4,4'-diaminodiphenyl ether in equimolar amounts were subjected to polycondensation reaction at 20° C. in dimethylacetamide serving as a solvent, to thereby obtain 400 g of a solution of aromatic PAd (thermally curable polyimide precursor) having a solid content concentration of 16% by mass. Then, 7 g of carbon black (Special Black 4, product of DEGUSSA Co., Ltd.) was added to the thus-obtained solution, and the resultant mixture was mixed and dispersed with a ball mill (zirconia media: 0.03 mm in diameter) to thereby prepare a liquid for forming a polyimide film containing carbon black.

The obtained liquid for forming a polyimide film containing carbon black was formed by the centrifugal molding method into an endless belt (average thickness: 80 μm, surface resistance: $1.3\times10^{10}$ Ω/sq.).

Note that, the surface resistance was measured using a HIGHRESTOR HR probe (DC100V, value at 10 sec, product of Mitsubishi Chemical Co., Ltd.).

Production Example 6

Synthesis of External Additive (Silica Particles)

A raw material was produced by the gaseous phase method, and the surface of the raw material was then treated with hexamethyldisilazane to thereby obtain silica particles s1 having an average primary particle diameter of 50 nm.

In the same manner as in the synthesis of the silica particles s1, silica particles s2 having an average primary particle diameter of 30 nm were obtained by the gaseous phase method.

Separately, a raw material was produced by the gaseous phase method, and the surface of the raw material was then treated with hexamethyldisilazane to thereby obtain silica particles s3 having an average primary particle diameter of 150 nm.

In the same manner as in the synthesis of the silica particles s3, silica particles s4 having an average primary particle diameter of 170 nm were obtained by the gaseous phase method.

The above average primary particle diameter was measured as follows. The external additives were photographed with an electron microscope. The obtained image was used to calculate the average primary particle diameter from the particle diameters and the number of the external additives present in the image.

Examples 2-1 to 2-4

Production of Toners 2-1 to 2-4

The raw materials presented in Tables 1 to 3 in accordance with the formulations presented in the following Table 6-1 and carbon black (product of Mitsubishi Chemical Co. Ltd.) (14 parts by mass) were premixed using HENSCHEL MIXER (product of Mitsui Miike Machinery Co., Ltd., FM20B) and then melt-kneaded at a temperature of 100° C. to 130° C. using a biaxial kneader (PCM-30, product of IKEGAI LTD.). The resultant kneaded product was rolled to an average thickness of 2.8 mm, then cooled to room temperature by a belt cooler and finally coarsely pulverized to 200 μm to 300 μm using a hammer mill. It was then finely pulverized using a supersonic jet mill LABOJET (product of Nippon Pneumatic Mfg. Co., Ltd.) and classified using a dispersion separator (MDS-I, product of Nippon Pneumatic Mfg. Co., Ltd.) while appropriately adjusting the opening of louvers so that the mass average particle diameter of the classified product was 5.6 μm±0.2 μm, whereby toner base particles were obtained. Then, each of the external additives in amounts presented in the following Table 6-1 and 100 parts by mass of the toner base particles were stirred and mixed together using HENSCHEL MIXER to produce toners 2-1 to 2-4.

A molecular weight distribution of the produced toners 2-1 to 2-4 was measured in the same manner as in Production Example 2, and a main peak of the molecular weight and a half width of the molecular weight distribution were determined. The results are presented in Table 7.

In addition, using a differential scanning calorimeter (DSC-60, product of Shimadzu Corporation, Ltd.), the DSC peak temperature and the endothermic amount in a range of 90° C. to 130° C. attributed to the crystalline polyester resin (A) of the toners 2-1 to 2-4 were determined from a DSC chart obtained when each of the toners 2-1 to 2-4 was raised in temperature from at 10° C./min from 20° C. to 150° C. The results are presented in Table 7.

Furthermore, the amount of the chloroform insoluble matter in the toner was confirmed in the same manner as in Production Example 2. The results are presented in Table 7.

<Production of Developer>

Next, 5% by mass of each of the produced toners 2-1 to 2-4 and 95% by mass of a coating ferrite carrier were uniformly mixed using a TURBULA mixer (product of Willy A. Bachofen AG Maschinenfabrik) at 48 rpm for 5 min, to thereby produce developers 2-1 to 2-4.

<Low-Temperature Fixing Property, Hot Offset Resistance, Thin-Line Reproducibility (Initial) and Solid Image Reproducibility (Initial)>

Using a modified machine of IMAGIO PRO900 (product of Ricoh Company, Ltd.), an image was printed using each of the above-produced developers.

Using the intermediate transfer member produced in the above Production Example thereof, a solid image with a deposited amount of 0.4 mg/cm$^2$ was printed on paper (TYPE6200, product of Ricoh Company, Ltd.) through exposing, developing and transfer steps. A linear velocity of fixing was set to 750 mm/sec. Images were printed with a fixing temperature increasing in increment of 5° C., and a lower-limit temperature (lower-limit fixing temperature: low-temperature fixing property) where no cold offset occurs and an upper-limit temperature (upper-limit fixing temperature: hot offset resistance) where no hot offset occurs were measured. An NIP width of the fixing device was 16 mm. Also, a character chart having an image area ratio of 5% (a character has a size of about 2 mm×about 2 mm) was printed out separately with the toner at a fixing temperature of the lower-limit fixing temperature+20° C., and thin-line reproducibility (initial) was visually evaluated. In addition, a 100% image of about 15 mm×about 15 mm was also printed out, and solid image reproducibility (initial) was visually evaluated. The results are presented in Table 8-1. Note that, the evaluation criteria for the evaluations are as follows.

<<Evaluation Criteria of Low-Temperature Fixing Property>>

A: less than 130° C.

B: 130° C. or greater but less than 140° C.

C: 140° C. or greater but less than 150° C.

D: 150° C. or greater but less than 160° C.

E: 160° C. or greater

<<Evaluation Criteria of Hot-Offset Resistance>>

A: 200° C. or greater

B: 190° C. or greater but less than 200° C.

C: 180° C. or greater but less than 190° C.

D: 170° C. or greater but less than 180° C.

E: less than 170° C.

<<Evaluation Criteria of Thin-Line Reproducibility (Initial)>>

A: particularly favorable

B: favorable

C: generally acceptable

D: no practical problem

E: not acceptable

<<Evaluation Criteria of Solid Image Reproducibility (Initial)>>

A: particularly favorable

B: favorable

C: generally acceptable

D: no practical problem

E: not acceptable

<Thin-Line Reproducibility (Over Time) and Solid Image Reproducibility (Over Time)>

After evaluation of the initial thin-line reproducibility, a character chart having an image area ratio of 5% (a character has a size of about 2 mm×about 2 mm) was continuously printed out on 100,000 sheets at a fixing temperature of the lower-limit fixing temperature+20° C. while the toner was supplied, and its thin-line reproducibility over time was visually evaluated. The same evaluation criteria as the initial thin-line reproducibility were used.

After evaluation of the initial solid image reproducibility, the character chart having an image area ratio of 5% was continuously printed out on 100,000 sheets. Then, a 100% image of about 15 mm×about 15 mm was printed out, and the resultant image was visually evaluated for solid image reproducibility (over time). The same evaluation criteria as the initial solid image reproducibility were used. The results are presented in Table 8-1.

<Smear Resistance>

At the lower-limit fixing temperature, a half-tone image having an image area ratio of 60% and a toner deposited amount of 0.40 mg/cm$^2$±0.1 mg/cm$^2$ was printed out on paper (TYPE6200, product of Ricoh Company, Ltd.). The fixed image portion was rubbed 10 times with a white cotton cloth (No. 3 cotton JIS L0803) using a clock meter, and an ID of the smear on the cloth (hereinafter referred to as smear ID) was measured. The smear ID was measured using a colorimeter (X-RITE 938, product of X-Rite, Co.). Here, the color in the measurement was black. The results are presented in Table 8-1.

<<Evaluation Criteria of Smear Resistance>>

A: Smear ID was 0.20 or less

B: Smear ID was greater than 0.20 but 0.35 or less

C: Smear ID was greater than 0.35 but 0.55 or less

D: Smear ID was greater than 0.55

<Heat Resistance Storageability>

In a 30-mL screw-top vial, 10 g of the toner was placed. The vial was tapped 100 times with a tapping machine and then stored in a thermostat at 50° C. for 24 hours. The vial was returned to room temperature, and the toner was measured for its penetration using a penetration testing machine as an evaluation of heat resistance storageability. The results are presented in Table 8-1.

<<Evaluation Criteria of Heat Resistance Storageability>>

A: complete penetration

B: 20 mm or greater

C: 15 mm or greater but less than 20 mm

D: 10 mm or greater but less than 15 mm

E: less than 10 mm

Examples 2-5 to 2-36 and Comparative Examples 2-1 to 2-36

Toners 2-5 to 2-72

Toners 2-5 to 2-72 and developers containing them were produced by performing the mixing, kneading, pulverizing, and mixing with additives in the same manner as in Examples 2-1 to 2-4 except that the amounts of the toner raw materials were changed as described in Tables 6-1 to 6-4. These toners and developers were evaluated in terms of the above evaluation items in the same manner as in Examples 2-1 to 2-4. The results are presented in Tables 7, 8-1, 8-2, 8-3, 8-4 and 8-5.

TABLE 6-1

| | | Crystalline polyester resin (A) Material/ [parts by mass] | Non-crystalline resin (B1) Material/ [parts by mass] | Non-crystalline resin (B2) Material/ [parts by mass] | Composite resin (C) Material/ [parts by mass] | External additive Material/ [parts by mass] |
|---|---|---|---|---|---|---|
| Ex. 2-1 | Toner 2-1 | a1/4 parts | b1-1/35 parts | b2-1/55 parts | c1/10 parts | s1/1 parts |
| Ex. 2-2 | Toner 2-2 | | | | | s2/0.8 parts |
| Ex. 2-3 | Toner 2-3 | | | | | s3/1.5 parts |
| Ex. 2-4 | Toner 2-4 | | | | | s4/1.8 parts |
| Comp. Ex. 2-1 | Toner 2-5 | Not used | b1-1/35 parts | b2-1/55 parts | c1/10 parts | s1/1 parts |
| Comp. Ex. 2-2 | Toner 2-6 | | | | | s2/0.8 parts |
| Comp. Ex. 2-3 | Toner 2-7 | | | | | s3/1.5 parts |
| Comp. Ex. 2-4 | Toner 2-8 | | | | | s4/1.8 parts |
| Comp. Ex. 2-5 | Toner 2-9 | a1/4 parts | Not used | b2-1/90 parts | c1/10 parts | s1/1 parts |
| Comp. Ex. 2-6 | Toner 2-10 | | | | | s2/0.8 parts |
| Comp. Ex. 2-7 | Toner 2-11 | | | | | s3/1.5 parts |
| Comp. Ex. 2-8 | Toner 2-12 | | | | | s4/1.8 parts |
| Comp. Ex. 2-9 | Toner 2-13 | a1/4 parts | b1-1/35 parts | b2-1/55 parts | Not used | s1/1 parts |
| Comp. Ex. 2-10 | Toner 2-14 | | | | | s2/0.8 parts |
| Comp. Ex. 2-11 | Toner 2-15 | | | | | s3/1.5 parts |
| Comp. Ex. 2-12 | Toner 2-16 | | | | | s4/1.8 parts |

TABLE 6-2

| | | Crystalline polyester resin (A) Material/ [parts by mass] | Non-crystalline resin (B1) Material/ [parts by mass] | Non-crystalline resin (B2) Material/ [parts by mass] | Composite resin (C) Material/ [parts by mass] | External additive Material/ [parts by mass] |
|---|---|---|---|---|---|---|
| Comp. Ex. 2-13 | Toner 2-17 | a1/4 parts | b1-1/45 parts | b2-1/45 parts | c1/10 parts | s1/1 parts |
| Comp. Ex. 2-14 | Toner 2-18 | | | | | s2/0.8 parts |
| Comp. Ex. 2-15 | Toner 2-19 | | | | | s3/1.5 parts |
| Comp. Ex. 2-16 | Toner 2-20 | | | | | s4/1.8 parts |
| Ex. 2-5 | Toner 2-21 | a1/4 parts | b1-1/40 parts | b2-1/50 parts | c1/10 parts | s1/1 parts |
| Ex. 2-6 | Toner 2-22 | | | | | s2/0.8 parts |
| Ex. 2-7 | Toner 2-23 | | | | | s3/1.5 parts |
| Ex. 2-8 | Toner 2-24 | | | | | s4/1.8 parts |
| Ex. 2-9 | Toner 2-25 | a1/4 parts | b1-1/25 parts | b2-1/65 parts | c1/10 parts | s1/1 parts |
| Ex. 2-10 | Toner 2-26 | | | | | s2/0.8 parts |
| Ex. 2-11 | Toner 2-27 | | | | | s3/1.5 parts |
| Ex. 2-12 | Toner 2-28 | | | | | s4/1.8 parts |
| Comp. Ex. 2-17 | Toner 2-29 | a1/4 parts | b1-1/20 parts | b2-1/70 parts | c1/10 parts | s1/1 parts |
| Comp. Ex. 2-18 | Toner 2-30 | | | | | s2/0.8 parts |
| Comp. Ex. 2-19 | Toner 2-31 | | | | | s3/1.5 parts |
| Comp. Ex. 2-20 | Toner 2-32 | | | | | s4/1.8 arts |
| Ex. 2-13 | Toner 2-33 | a1/4 parts | b1-1/28 parts | b2-1/62 parts | c1/5 parts | s1/1 parts |
| Ex. 2-14 | Toner 2-34 | | | | | s2/0.8 parts |
| Ex. 2-15 | Toner 2-35 | | | | | s3/1.5 parts |
| Ex. 2-16 | Toner 2-36 | | | | | s4/1.8 parts |

TABLE 6-3

| | | Crystalline polyester resin (A) Material/ [parts by mass] | Non-crystalline resin (B1) Material/ [parts by mass] | Non-crystalline resin (B2) Material/ [parts by mass] | Composite resin (C) Material/ [parts by mass] | External additive Material/ [parts by mass] |
|---|---|---|---|---|---|---|
| Comp. Ex. 2-21 | Toner 2-37 | a1/4 parts | b1-1/30 parts | b2-1/60 parts | c1/5 parts | s1/1 parts |
| Comp. Ex. 2-22 | Toner 2-38 | | | | | s2/0.8 parts |
| Comp. Ex. 2-23 | Toner 2-39 | | | | | s3/1.5 parts |
| Comp. Ex. 2-24 | Toner 2-40 | | | | | s4/1.8 parts |
| Comp. Ex. 2-25 | Toner 2-41 | a2/4 parts | b1-1/35 parts | b2-1/55 parts | c1/10 parts | s1/1 parts |
| Comp. Ex. 2-26 | Toner 2-42 | | | | | s2/0.8 parts |
| Comp. Ex. 2-27 | Toner 2-43 | | | | | s3/1.5 parts |
| Comp. Ex. 2-28 | Toner 2-44 | | | | | s4/1.8 parts |
| Ex. 2-17 | Toner 2-45 | a3/4 parts | b1-1/35 parts | b2-1/55 parts | c1/10 parts | s1/1 parts |
| Ex. 2-18 | Toner 2-46 | | | | | s2/0.8 parts |
| Ex. 2-19 | Toner 2-47 | | | | | s3/1.5 parts |
| Ex. 2-20 | Toner 2-48 | | | | | s4/1.8 parts |
| Ex. 2-21 | Toner 2-49 | a4/4 parts | b1-1/35 parts | b2-1/55 parts | c1/10 parts | s1/1 parts |
| Ex. 2-22 | Toner 2-50 | | | | | s2/0.8 parts |
| Ex. 2-23 | Toner 2-51 | | | | | s3/1.5 parts |
| Ex. 2-24 | Toner 2-52 | | | | | s4/1.8 parts |

TABLE 6-4

| | | Crystalline polyester resin (A) Material/ [parts by mass] | Non-crystalline resin (B1) Material/ [parts by mass] | Non-crystalline resin (B2) Material/ [parts by mass] | Composite resin (C) Material/ [parts by mass] | External additive Material/ [parts by mass] |
|---|---|---|---|---|---|---|
| Comp. Ex. 2-29 | Toner 2-53 | a5/4 parts | b1-1/35 parts | b2-1/55 parts | c1/10 parts | s1/1 parts |
| Comp. Ex. 2-30 | Toner 2-54 | | | | | s2/0.8 parts |
| Comp. Ex. 2-31 | Toner 2-55 | | | | | s3/1.5 parts |
| Comp. Ex. 2-32 | Toner 2-56 | | | | | s4/1.8 parts |
| Ex. 2-25 | Toner 2-57 | a1/4 parts | b1-2/35 parts | b2-2/55 parts | c1/10 parts | s1/1 parts |
| Ex. 2-26 | Toner 2-58 | | | | | s2/0.8 parts |
| Ex. 2-27 | Toner 2-59 | | | | | s3/1.5 parts |
| Ex. 2-28 | Toner 2-60 | | | | | s4/1.8 parts |
| Ex. 2-29 | Toner 2-61 | a1/4 parts | b1-3/75 parts | b2-2/15 parts | c1/10 parts | s1/1 parts |
| Ex. 2-30 | Toner 2-62 | | | | | s2/0.8 parts |
| Ex. 2-31 | Toner 2-63 | | | | | s3/1.5 parts |
| Ex. 2-32 | Toner 2-64 | | | | | a4/1.8 parts |
| Comp. Ex. 2-33 | Toner 2-65 | a1/4 parts | b1-3/80 parts | b2-2/10 parts | c1/10 parts | s1/1 parts |
| Comp. Ex. 2-34 | Toner 2-66 | | | | | s2/0.8 parts |
| Comp. Ex. 2-35 | Toner 2-67 | | | | | s3/1.5 parts |
| Comp. Ex. 2-36 | Toner 2-68 | | | | | s4/1.8 parts |
| Ex. 2-33 | Toner 2-69 | a6/1 parts | b1-1/35 parts | b2-2/55 parts | c1/10 parts | s1/1 parts |
| Ex. 2-34 | Toner 2-70 | | | | | s2/0.8 parts |
| Ex. 2-35 | Toner 2-71 | | | | | s3/1.5 parts |
| Ex. 2-36 | Toner 2-72 | | | | | s4/1.8 parts |

TABLE 7

| Toner | Crystalline polyester resin (A) | Non-crystalline resin (B1) | Non-crystalline resin (B2) | Composite resin (C) | Main peak of M.W. of toner | Half width of M.W. of toner | DSC peak temp. [° C.] | Endothermic amount of DSC peak [J/g] | Chloroform insoluble matter (% by mass) |
|---|---|---|---|---|---|---|---|---|---|
| 2-1 to 2-4 | a1 | b1-1 | b2-1 | c1 | 7400 | 13000 | 108 | 5 | 7 |
| 2-5 to 2-8 | — | b1-1 | b2-1 | c1 | 7400 | 13000 | — | — | 7 |
| 2-9 to 2-12 | a1 | — | b2-1 | c1 | 7400 | 13000 | 108 | 5 | 0 |
| 2-13 to 2-16 | a1 | b1-1 | b2-1 | — | 7400 | 13000 | 108 | 5 | 6 |
| 2-17 to 2-20 | a1 | b1-1 | b2-1 | c1 | 900 | 9000 | 108 | 5 | 3 |
| 2-21 to 2-24 | a1 | b1-1 | b2-1 | c1 | 1100 | 10000 | 108 | 5 | 4 |
| 2-25 to 2-28 | a1 | b1-1 | b2-1 | c1 | 9800 | 13800 | 108 | 5 | 8 |
| 2-29 to 2-32 | a1 | b1-1 | b2-1 | c1 | 11000 | 14100 | 108 | 5 | 8 |
| 2-33 to 2-36 | a1 | b1-1 | b2-1 | c1 | 8800 | 14500 | 108 | 5 | 4 |
| 2-37 to 2-40 | a1 | b1-1 | b2-1 | c1 | 9000 | 16000 | 108 | 5 | 6 |
| 2-41 to 2-44 | a2 | b1-1 | b2-1 | c1 | 7400 | 13000 | 88 | 5 | 7 |
| 2-45 to 2-48 | a3 | b1-1 | b2-1 | c1 | 7400 | 13000 | 92 | 5 | 7 |
| 2-49 to 2-52 | a4 | b1-1 | b2-1 | c1 | 7400 | 13000 | 127 | 5 | 7 |
| 2-53 to 2-56 | a5 | b1-1 | b2-1 | c1 | 7400 | 13000 | 131 | 5 | 7 |
| 2-57 to 2-60 | a1 | b1-2 | b2-2 | c1 | 3500 | 8500 | 108 | 5 | 1 |
| 2-61 to 2-64 | a1 | b1-3 | b2-2 | c1 | 9500 | 13000 | 108 | 5 | 29 |

TABLE 7-continued

| Toner | Crystalline polyester resin (A) | Non-crystalline resin (B1) | Non-crystalline resin (B2) | Composite resin (C) | Main peak of M.W. of toner | Half width of M.W. of toner | DSC peak temp. [° C.] | Endothermic amount of DSC peak [J/g] | Chloroform insoluble matter (% by mass) |
|---|---|---|---|---|---|---|---|---|---|
| 2-65 to 2-68 | a1 | b1-3 | b2-2 | c1 | 9500 | 14000 | 108 | 5 | 31 |
| 2-69 to 2-72 | a6 | b1-1 | b2-2 | c1 | 7200 | 12500 | 110 | 5 | 7 |

TABLE 8-1

| | | Low-temp. fixing property | Hot offset resistance | Thin-line reproducibility (initial) | Thin-line reproducibility (over time) | Heat resistance storageability | Smear resistance | Solid image reproducibility (initial) | Solid image reproducibility (over time) |
|---|---|---|---|---|---|---|---|---|---|
| Ex. 2-1 | Toner 2-1 | B | A | A | A | B | B | A | B |
| Ex. 2-2 | Toner 2-2 | B | B | A | B | B | B | B | C |
| Ex. 2-3 | Toner 2-3 | B | A | A | A | A | B | A | B |
| Ex. 2-4 | Toner 2-4 | C | A | A | A | A | C | A | A |
| Comp. Ex. 2-1 | Toner 2-5 | E | A | A | A | B | C | A | C |
| Comp. Ex. 2-2 | Toner 2-6 | C | B | A | A | C | B | B | E |
| Comp. Ex. 2-3 | Toner 2-7 | E | A | A | A | B | C | A | B |
| Comp. Ex. 2-4 | Toner 2-8 | E | A | A | A | A | D | A | B |
| Comp. Ex. 2-5 | Toner 2-9 | A | E | A | C | E | B | B | C |
| Comp. Ex. 2-6 | Toner 2-10 | A | E | A | C | E | A | B | E |
| Comp. Ex. 2-7 | Toner 2-11 | B | C | A | B | C | D | A | B |
| Comp. Ex. 2-8 | Toner 2-12 | B | C | A | B | C | D | A | B |
| Comp. Ex 2-9 | Toner 2-13 | B | B | B | C | E | B | B | C |
| Comp. Ex. 2-10 | Toner 2-14 | B | B | B | C | E | B | B | E |
| Comp. Ex. 2-11 | Toner 2-15 | C | B | B | C | E | B | A | B |
| Comp. Ex. 2-12 | Toner 2-16 | D | B | B | C | E | C | A | B |

TABLE 8-2

| | | Low-temp. fixing property | Hot offset resistance | Thin-line reproducibility (initial) | Thin-line reproducibility (over time) | Heat resistance storageability | Smear resistance | Solid image reproducibility (initial) | Solid image reproducibility (over time) |
|---|---|---|---|---|---|---|---|---|---|
| Comp. Ex. 2-13 | Toner 2-17 | B | E | A | B | E | B | B | C |
| Comp. Ex. 2-14 | Toner 2-18 | B | E | A | B | E | B | B | E |
| Comp. Ex. 2-15 | Toner 2-19 | C | C | A | B | E | C | A | B |
| Comp. Ex. 2-16 | Toner 2-20 | D | C | A | B | E | C | A | B |
| Ex. 2-5 | Toner 2-21 | B | C | A | B | B | B | A | B |
| Ex. 2-6 | Toner 2-22 | B | C | A | B | B | B | B | C |
| Ex. 2-7 | Toner 2-23 | B | C | A | B | B | B | A | B |
| Ex. 2-8 | Toner 2-24 | C | B | A | B | A | C | A | A |
| Ex. 2-9 | Toner 2-25 | C | B | A | A | B | B | A | B |
| Ex. 2-10 | Toner 2-26 | C | B | A | A | B | B | B | C |
| Ex. 2-11 | Toner 2-27 | C | B | A | A | B | B | A | A |
| Ex. 2-12 | Toner 2-28 | C | A | A | A | A | C | A | A |
| Comp. Ex. 2-17 | Toner 2-29 | E | B | A | A | B | B | A | B |
| Comp. Ex. 2-18 | Toner 2-30 | E | B | A | A | B | B | A | E |
| Comp. Ex. 2-19 | Toner 2-31 | E | B | A | A | B | C | A | B |
| Comp. Ex. 2-20 | Toner 2-32 | E | A | A | A | A | D | A | A |

TABLE 8-3

| | | Low-temp. fixing property | Hot offset resistance | Thin-line reproducibility (initial) | Thin-line reproducibility (over time) | Heat resistance storageability | Smear resistance | Solid image reproducibility (initial) | Solid image reproducibility (over time) |
|---|---|---|---|---|---|---|---|---|---|
| Ex. 2-13 | Toner 2-33 | C | B | A | A | B | B | A | B |
| Ex. 2-14 | Toner 2-34 | C | B | A | A | B | B | B | C |
| Ex. 2-15 | Toner 2-35 | C | B | A | A | B | B | A | B |
| Ex. 2-16 | Toner 2-36 | C | A | A | A | A | B | A | A |
| Comp. Ex. 2-21 | Toner 2-37 | E | B | A | A | B | B | B | C |
| Comp. Ex. 2-22 | Toner 2-38 | E | B | A | A | B | B | B | E |
| Comp. Ex. 2-23 | Toner 2-39 | E | B | A | A | B | C | A | B |

TABLE 8-3-continued

| | | Low-temp. fixing property | Hot offset resistance | Thin-line reproducibility (initial) | Thin-line reproducibility (over time) | Heat resistance storageability | Smear resistance | Solid image reproducibility (initial) | Solid image reproducibility (over time) |
|---|---|---|---|---|---|---|---|---|---|
| Comp. Ex. 2-24 | Toner 2-40 | E | B | A | A | B | D | A | B |
| Comp. Ex. 2-25 | Toner 2-41 | B | C | A | A | E | B | B | C |
| Comp. Ex. 2-26 | Toner 2-42 | B | C | A | A | E | B | B | E |
| Comp. Ex. 2-27 | Toner 2-43 | B | C | A | A | E | B | A | B |
| Comp. Ex. 2-28 | Toner 2-44 | B | C | A | A | E | B | A | B |
| Ex. 2-17 | Toner 2-45 | B | B | A | A | B | B | A | B |
| Ex. 2-18 | Toner 2-46 | B | B | A | A | B | B | B | C |
| Ex. 2-19 | Toner 2-47 | B | B | A | A | B | B | A | B |
| Ex. 2-20 | Toner 2-48 | C | B | A | A | B | C | A | B |

TABLE 8-4

| | | Low-temp. fixing property | Hot offset resistance | Thin-line reproducibility (initial) | Thin-line reproducibility (over time) | Heat resistance storageability | Smear resistance | Solid image reproducibility (initial) | Solid image reproducibility (over time) |
|---|---|---|---|---|---|---|---|---|---|
| Ex. 2-21 | Toner 2-49 | B | B | A | A | B | B | A | B |
| Ex. 2-22 | Toner 2-50 | B | B | A | A | B | B | B | C |
| Ex. 2-23 | Toner 2-51 | B | B | A | A | B | B | A | B |
| Ex. 2-24 | Toner 2-52 | C | B | A | A | B | C | A | A |
| Comp. Ex. 2-29 | Toner 2-53 | E | B | A | A | B | C | A | B |
| Comp. Ex. 2-30 | Toner 2-54 | E | B | A | A | B | B | B | E |
| Comp. Ex. 2-31 | Toner 2-55 | E | B | A | A | B | D | A | B |
| Comp. Ex. 2-32 | Toner 2-56 | E | B | A | A | B | D | A | A |
| Ex. 2-25 | Toner 2-57 | B | C | A | B | C | A | B | C |
| Ex. 2-26 | Toner 2-58 | A | C | A | B | C | A | B | C |
| Ex. 2-27 | Toner 2-59 | B | C | A | B | C | B | B | C |
| Ex. 2-28 | Toner 2-60 | C | C | A | B | B | B | B | C |
| Ex. 2-29 | Toner 2-61 | C | A | A | A | A | B | A | B |
| Ex. 2-30 | Toner 2-62 | C | A | A | A | A | A | B | C |
| Ex. 2-31 | Toner 2-63 | C | A | A | A | A | B | A | B |
| Ex. 2-32 | Toner 2-64 | C | A | A | A | A | C | A | B |

TABLE 8-5

| | | Low-temp. fixing property | Hot offset resistance | Thin-line reproducibility (initial) | Thin-line reproducibility (over time) | Heat resistance storageability | Smear resistance | Solid image reproducibility (initial) | Solid image reproducibility (over time) |
|---|---|---|---|---|---|---|---|---|---|
| Comp. Ex. 2-33 | Toner 2-65 | E | A | A | A | A | B | A | B |
| Comp. Ex. 2-34 | Toner 2-66 | E | A | A | A | A | A | B | E |
| Comp. Ex. 2-35 | Toner 2-67 | E | A | A | A | A | C | A | B |
| Comp. Ex. 2-36 | Toner 2-68 | E | A | A | A | A | D | A | B |
| Ex. 2-33 | Toner 2-69 | A | B | A | A | A | B | A | B |
| Ex. 2-34 | Toner 2-70 | A | B | A | A | A | A | B | C |
| Ex. 2-35 | Toner 2-71 | B | B | A | A | A | C | A | B |
| Ex. 2-36 | Toner 2-72 | C | B | A | A | A | C | A | B |

Aspects of the present invention are, for example, as follows.

<1> A toner, including:

a binder resin; and a colorant, wherein the binder resin contains: a crystalline polyester resin (A); a non-crystalline resin (B); and a composite resin (C), where the composite resin (C) contains a condensation polymerization resin unit and an addition polymerization resin unit, wherein the toner contains chloroform insoluble matter in an amount of 1% by mass to 30% by mass, wherein the toner has a molecular weight distribution having a main peak in a range of 1,000 to 10,000 and a half width of 15,000 or less, where the molecular weight distribution is obtained through gel permeation chromatography (GPC) of tetrahydrofuran soluble matter of the toner, and wherein the toner has an endothermic peak in a range of 90° C. to 130° C. in measurement through differential scanning calorimetry (DSC).

<2> The toner according to <1>, wherein an endothermic amount in the endothermic peak is 1 J/g to 15 J/g.

<3> The toner according to <1> or <2>, wherein the toner contains the chloroform insoluble matter in an amount of 2% by mass to 20% by mass.

<4> The toner according to any one of <1> to <3>, further including a fatty acid amide compound.

<5> The toner according to any one of <1> to <4>, further including a salicylic acid metal compound.

<6> The toner according to any one of <1> to <5>, wherein the crystalline polyester resin (A) contains an ester bond represented by the following General Formula (1) in a molecular backbone thereof:

$$—[OCO—R—COO—(CH_2)_n]— \quad \text{General Formula (1)}$$

where R represents a C2-C20 linear, unsaturated, aliphatic, divalent carboxylic acid residue, and n is an integer of 2 to 20.

<7> The toner according to any one of <1> to <6>, wherein the condensation polymerization resin unit of the composite resin (C) is a polyester resin unit and the addition polymerization resin unit of the composite resin (C) is a vinyl resin unit.

<8> The toner according to any one of <1> to <7>, further including an external additive, wherein the external additive is an inorganic compound having an average primary particle diameter of 40 nm to 160 nm.

<9> An image forming apparatus, including:

an electrophotographic photoconductor;

a charging unit configured to charge a surface of the electrophotographic photoconductor;

an exposing unit configured to expose the charged surface of the electrophotographic photoconductor to light to form a latent electrostatic image;

a developing unit configured to develop the latent electrostatic image with a toner to form a visible image; and a transferring unit configured to transfer the visible image to a recording medium, wherein the toner is the toner according to any one of <1> to <8>.

<10> An image forming method, including:

charging a surface of an electrophotographic photoconductor;

exposing the charged surface of the electrophotographic photoconductor to light to form a latent electrostatic image;

developing the latent electrostatic image with a toner to form a visible image;

transferring the visible image to a recording medium; and wherein the toner is the toner according to any one of <1> to <8>.

<11> The image forming method according to <10>, wherein in the transferring, the visible image is transferred via an intermediate transfer member to the recording medium.

<12> The image forming method according to <11>, wherein a material of the intermediate transfer member is a polyimide.

<13> A process cartridge, including:

an electrophotographic photoconductor; and a developing unit configured to develop a latent electrostatic image on the electrophotographic photoconductor with a toner to form a visible image, wherein the process cartridge is detachably mounted to a main body of an image forming apparatus, and wherein the toner is the toner according to any one of <1> to <8>.

This application claims priority to Japanese application No. 2012-058440, filed on Mar. 15, 2012, Japanese application No. 2012-199704, filed on Sep. 11, 2012, and Japanese application No. 2013-048923, filed on Mar. 12, 2013, and incorporated herein by reference.

What is claimed is:

1. A toner, comprising:

a binder resin; and a colorant, wherein the binder resin comprises: a crystalline polyester resin (A); a non-crystalline resin (B); and a composite resin (C), where the composite resin (C) comprises a condensation polymerization resin unit and an addition polymerization resin unit, the non-crystalline resin (B) is present in an amount of 60 to 95% by mass, wherein the toner comprises chloroform insoluble matter in an amount of 1% by mass to 30% by mass, wherein the toner has a molecular weight distribution having a main peak in a range of 1,000 to 10,000 and a half width of 15,000 or less, where the molecular weight distribution is obtained through gel permeation chromatography (GPC) of tetrahydrofuran soluble matter of the toner, wherein the toner has an endothermic peak in a range of 90° C. to 130° C. in measurement through differential scanning calorimetry (DSC), and wherein composite resin (C) acts to lessen reduction of both heat resistance storageability and electrical resistance due to the combination of crystalline polyester resin (A) and non-crystalline resin (B).

2. The toner according to claim 1, wherein an endothermic amount in the endothermic peak is 1 J/g to 15 J/g.

3. The toner according to claim 1, wherein the toner comprises the chloroform insoluble matter in an amount of 2% by mass to 20% by mass.

4. The toner according to claim 1, further comprising a fatty acid amide compound.

5. The toner according to claim 1, further comprising a salicylic acid metal compound.

6. The toner according to claim 1, wherein the crystalline polyester resin (A) comprises an ester bond represented by the following General Formula (1) in a molecular backbone thereof:

$$—[OCO—R—COO—(CH_2)_n]— \quad \text{General Formula (1)}$$

where R represents a C2-C20 linear, unsaturated, aliphatic, divalent carboxylic acid residue, and n is an integer of 2 to 20.

7. The toner according to claim 1, wherein the condensation polymerization resin unit of the composite resin (C) is a polyester resin unit and the addition polymerization resin unit of the composite resin (C) is a vinyl resin unit.

8. The toner according to claim 1, further comprising an external additive, wherein the external additive is an inorganic compound having an average primary particle diameter of 40 nm to 160 nm.

9. The toner according to claim 1, wherein the non-crystalline resin (B) comprises a polyester resin.

10. The toner according to claim 1, wherein crystalline polyester resin (A) is present in an amount of 1 to 15% by mass; and the composite resin (C) is present in an amount of 3 to 20% by mass.

11. The toner according to claim 1, wherein the composite resin (C) comprises a polyester unit as the condensation polymerization resin unit and a vinyl resin unit as the addition polymerization resin unit.

12. The toner according to claim 1, wherein crystalline polyester resin (A) has a softening temperature of 80 to 130° C.

13. The toner according to claim 1, wherein the composite resin (C) has a softening temperature of 90 to 130° C.

14. The toner according to claim 1, wherein the molecular weight distribution has a main peak in a range of 1,200 to 9,000 and the half width is 14,000 or less.

15. The toner according to claim 1, wherein the toner comprises the chloroform insoluble matter in an amount of 3% by mass to 20% by mass.

16. The toner according to claim 1, wherein the non-crystalline resin (B) contributes to the chloroform insoluble matter amount of the toner.

17. A toner, comprising:

a binder resin; and a colorant, wherein the binder resin comprises: a crystalline polyester resin (A); a non-crystalline resin (B); and a composite resin (C), where the composite resin (C) comprises a condensation polymerization resin unit and an addition polymerization resin unit, wherein the non-crystalline resin (B) is present in an amount of 60 to 95% by mass, wherein the condensation polymerization resin unit is obtained from one of the following monomer mixtures (1), (2) or (3): (1) a polyhydric alcohol and a polyhydric carboxylic acid, (2) a polyvalent carboxylic acid, and an amine or an amino acid, or (3) any combination of (1) and (2), wherein the addition polymerization resin unit is obtained from a vinyl monomer, wherein the toner comprises chloroform insoluble matter in an amount of 1% by mass to 30% by mass, wherein the toner has a molecular weight distribution having a main peak in a range of 1,000 to 10,000 and a half width of 15,000 or less, where the molecular weight distribution is obtained through gel permeation chromatography (GPC) of tetrahydrofuran soluble matter of the toner, and wherein the toner has an endothermic peak in a range of 90° C. to 130° C. in measurement through differential scanning calorimetry (DSC).

18. The toner according to claim 17, wherein the non-crystalline resin (B) contributes to the chloroform insoluble matter amount of the toner.

19. A toner, comprising:

a binder resin; and a colorant, wherein the binder resin comprises: a crystalline polyester resin (A); a non-crystalline resin (B); and a composite resin (C), where the composite resin (C) comprises a condensation polymerization resin unit and an addition polymerization resin unit, wherein the non-crystalline resin (B) is a polyester resin, a styrene-acrylic acid ester copolymer, or a combination of both, and is present in an amount of 60 to 95% by mass, wherein the toner comprises chloroform insoluble matter in an amount of 1% by mass to 30% by mass, wherein the toner has a molecular weight distribution having a main peak in a range of 1,000 to 10,000 and a half width of 15,000 or less, where the molecular weight distribution is obtained through gel permeation chromatography (GPC) of tetrahydrofuran soluble matter of the toner, and wherein the toner has an endothermic peak in a range of 90° C. to 130° C. in measurement through differential scanning calorimetry (DSC).

20. The toner according to claim 19, wherein the non-crystalline resin (B) contributes to the chloroform insoluble matter amount of the toner.

* * * * *